US005655691A

United States Patent [19]

Stern et al.

[11] Patent Number: 5,655,691

[45] Date of Patent: Aug. 12, 1997

[54] SPRAY TEXTURING DEVICE

[75] Inventors: Donald J. Stern, Bellingham; James A. Tryon, Seattle, both of Wash.

[73] Assignee: Homax Products, Inc., Bellingham, Wash.

[21] Appl. No.: 451,732

[22] Filed: May 26, 1995

Related U.S. Application Data

[63] Continuation-in-part of Ser. No. 321,559, Oct. 12, 1994, Pat. No. 5,524,798, which is a continuation-in-part of Ser. No. 238,471, May 5, 1994, Pat. No. 5,409,148, which is a continuation of Ser. No. 840,795, Feb. 24, 1992, Pat. No. 5,310,095, and a continuation of Ser. No. 327,111, Oct. 21, 1994, abandoned, which is a continuation of Ser. No. 216,155, Mar. 22, 1994, Pat. No. 5,450,983.

[51] Int. Cl.[6] ..... B65D 83/14

[52] U.S. Cl. ..... 222/402.1; 239/391; 239/397

[58] Field of Search ..... 222/402.17, 402.1, 222/394, 564, 389, 386.5, 95, 105; 239/1, 337, 390, 391, 393, 394, 346, 345, 348, 599, 597, 596, 9, 428.5, 499, 590

[56] References Cited

U.S. PATENT DOCUMENTS

| | | | |
|---|---|---|---|
| D. 25,916 | 8/1896 | Woods . | |
| Re. 30,093 | 9/1979 | Burger . | |
| D. 134,562 | 12/1942 | Murphy . | |
| D. 307,649 | 5/1990 | Henry . | |
| D. 358,989 | 6/1995 | Woods . | |
| 2,388,093 | 10/1945 | Smith . | |
| 2,686,652 | 8/1954 | Carlson et al. . | |
| 2,764,454 | 9/1956 | Edelstein . | |
| 2,785,926 | 3/1957 | Lataste . | |
| 2,790,680 | 4/1957 | Rosholt . | |
| 2,831,618 | 4/1958 | Soffer et al. . | |
| 2,839,225 | 6/1958 | Soffer et al. . | |
| 2,965,270 | 12/1960 | Soffer et al. . | |
| 3,083,872 | 4/1963 | Meshberg | 239/394 |
| 3,167,525 | 1/1965 | Thomas . | |
| 3,191,809 | 6/1965 | Schultz et al. . | |
| 3,196,819 | 7/1965 | Lechner et al. . | |
| 3,314,571 | 4/1967 | Greenebaum | 222/564 |
| 3,342,382 | 9/1967 | Huling . | |
| 3,346,195 | 10/1967 | Groth . | |
| 3,377,028 | 4/1968 | Bruggeman . | |
| 3,415,425 | 12/1968 | Knight et al. . | |
| 3,433,391 | 3/1969 | Krizka et al. . | |
| 3,450,314 | 6/1969 | Gross . | |
| 3,467,283 | 9/1969 | Kinnavy . | |

(List continued on next page.)

FOREIGN PATENT DOCUMENTS

| | | | |
|---|---|---|---|
| 770467 | 10/1967 | Canada | 222/564 |
| 1586067 | 2/1970 | France . | |
| 3806991 A | 9/1989 | Germany . | |
| 867713 | 5/1961 | United Kingdom . | |
| 1144385 | 3/1969 | United Kingdom . | |

OTHER PUBLICATIONS

Homax Brochure, EasyTouch Spray Texture, released Mar. 1982.

*Primary Examiner*—Philippe Derakshani

*Attorney, Agent, or Firm*—Hughes, Multer & Schacht, P.S.

[57] ABSTRACT

Art apparatus for applying spray texture to a wall or the like. The apparatus comprises an aerosol can containing pressurized spray texture material. The spray texture material is released from the can by a valve and passes through a nozzle passageway, out of a discharge opening, and on to a surface to be textured. The apparatus further comprises an outlet member that can be placed over the discharge opening to vary the effective cross-sectional area thereof. This outlet member can be in the form of a straw or tube that is inserted into the nozzle passageway or a disc or other member having a plurality of outlet orifices formed therein. The outlet member having a plurality of outlet orifices can be attached directly to an actuator member in which the dispensing passageway is formed. By rotating, sliding, or otherwise moving the outlet member relative to the actuator member, any one of the outlet orifices in the outlet member can be arranged at the end of the nozzle passageway to vary the effective cross-sectional area of the discharge opening.

14 Claims, 10 Drawing Sheets

U.S. PATENT DOCUMENTS 3,482,738 12/1969 Bartels .
3,503,882 3/1970 Fitch .
3,544,258 12/1970 Presant et al. .
3,548,564 12/1970 Bruce et al. .
3,592,359 7/1971 Marrafino .
3,596,835 8/1971 Smith et al. .
3,648,932 3/1972 Ewald et al. ..... 239/428.5
3,700,136 10/1972 Ruekberg .
3,704,831 12/1972 Clark .
3,788,521 1/1974 Laauwe .
3,806,005 4/1974 Prussin et al. .
3,814,326 6/1974 Bartlett .
3,819,119 6/1974 Coffey .
3,828,977 8/1974 Borchert .
3,862,705 1/1975 Beres et al. .
3,891,128 6/1975 Smrt .
3,913,842 10/1975 Singer .
3,938,708 2/1976 Burger .
3,982,698 9/1976 Anderson .
3,989,165 11/1976 Shaw et al. .
3,992,003 11/1976 Visceglia et al. .
4,032,064 6/1977 Giggard .
4,045,860 9/1977 Winckler .
4,089,443 5/1978 Zrinyi .
4,117,951 10/1978 Winckler .
4,148,416 4/1979 Gunn-Smith .
4,154,378 5/1979 Paoletti et al. .
4,171,757 10/1979 Diamond .
4,185,758 1/1980 Giggard .
4,187,959 2/1980 Pelton .
4,187,985 2/1980 Goth ..... 239/428.5
4,197,357 4/1980 Huisman .
4,198,365 4/1980 Pelton .
4,229,312 10/1980 Nagashiro et al. .
4,238,264 12/1980 Pelton .
4,293,353 10/1981 Pelton et al. .
4,308,973 1/1982 Irland .
4,322,020 3/1982 Stone .
4,346,743 8/1982 Miller .
4,358,388 11/1982 Daniel et al. .
4,370,930 2/1983 Strasser et al. .
4,401,271 8/1983 Hansen .
4,401,272 8/1983 Merton et al. .
4,412,929 11/1983 Lysenko et al. .
4,417,674 11/1983 Giuffredi .
4,442,959 4/1984 Del Bon et al. .
4,444,937 4/1984 Badertscher .
4,493,778 1/1985 Iqbal .
4,609,608 9/1986 Solc .
4,641,765 2/1987 Diamond .
4,818,781 4/1989 Yamakawa et al. .
4,854,482 8/1989 Bergner .
4,870,805 10/1989 Morane .
4,896,832 1/1990 Howlett .
4,940,171 7/1990 Gilroy .
4,949,871 8/1990 Flanner .
4,969,577 11/1990 Werding .
5,007,556 4/1991 Lover .
5,028,497 7/1991 Somezawa et al. .
5,037,011 8/1991 Woods .
5,038,964 8/1991 Bouix .
5,059,187 10/1991 Sperry et al. .
5,100,055 3/1992 Rokitenetz .
5,115,944 5/1992 Nikolich .
5,126,086 6/1992 Stoffel .
5,188,263 2/1993 Woods .
5,211,317 5/1993 Diamond et al. .
5,307,964 5/1994 Toth .
5,310,095 5/1994 Stern et al. ..... 222/402.1
5,341,970 8/1994 Woods .
5,409,148 4/1995 Stern et al. ..... 222/402.1
5,421,519 6/1995 Woods .
5,450,983 9/1995 Stern et al. ..... 222/394
5,524,798 6/1996 Stern et al. ..... 239/393

160
174
162
176
164
172
166
136
126
124
158
168
170
D,E,F
$d_a$
$d_1$
X
$d_c$
A,G
128a
178
130
156
138
150
154
134
122
140
132
144
146
142
148
152

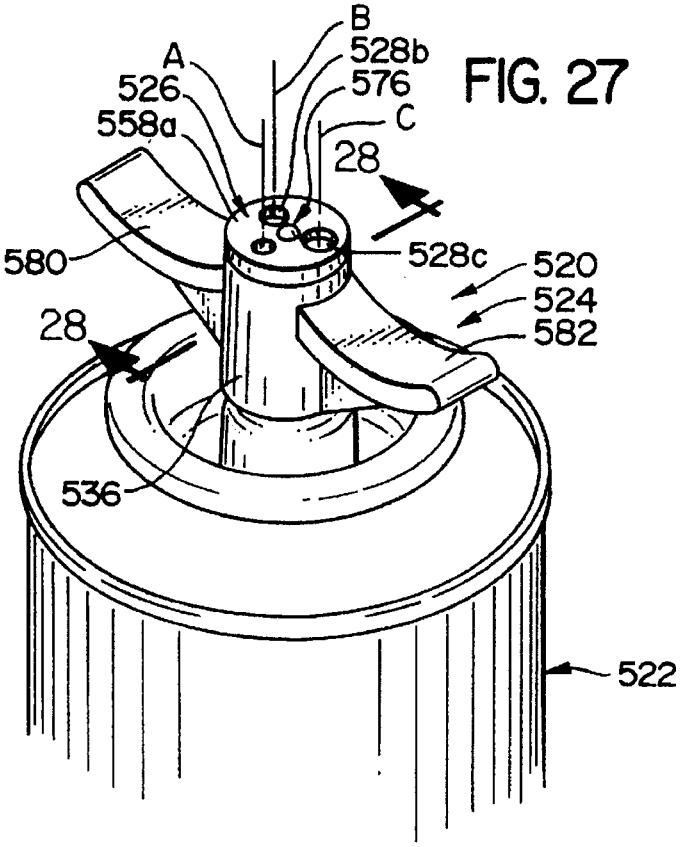
FIG. 27
FIG. 28
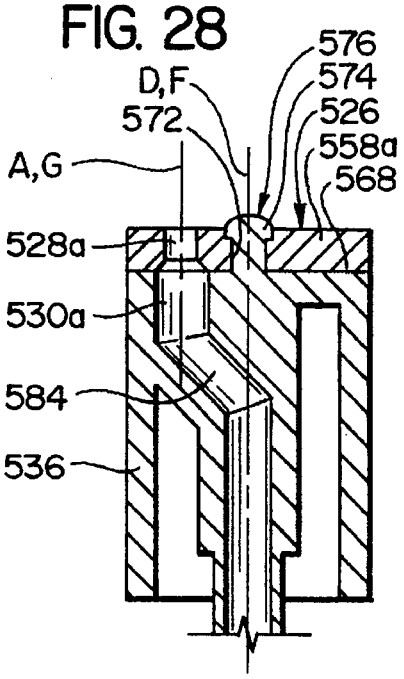
FIG. 29
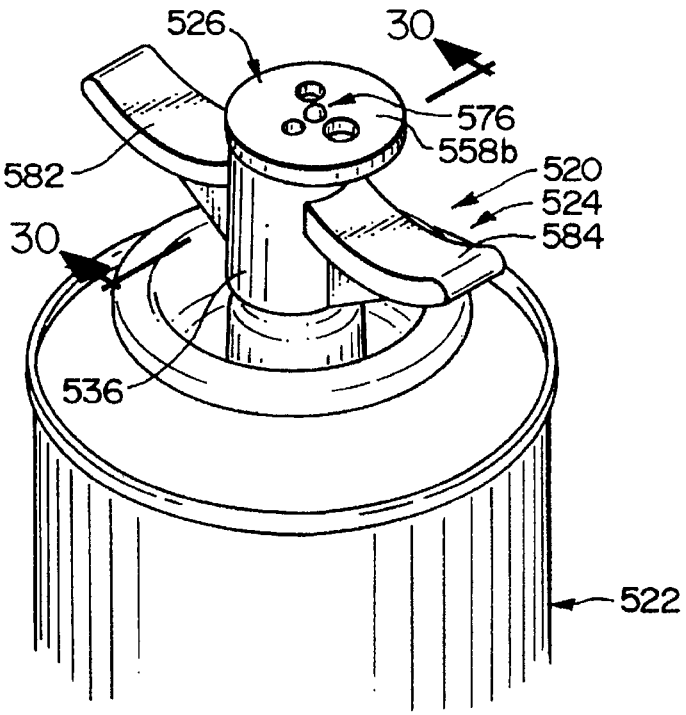
FIG. 30
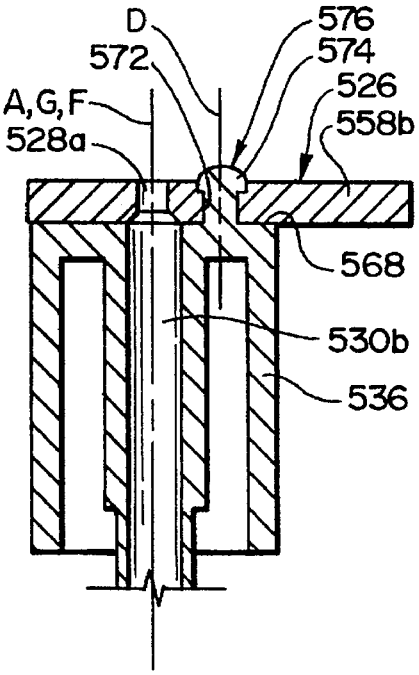

SPRAY TEXTURING DEVICE

RELATED APPLICATIONS

This is a continuation-in-part of U.S. Ser. No. 08/321,559 filed Oct. 12, 1994, now U.S. Pat. No. 5,524,798 which was a continuation-in-part of U.S. Ser. No. 08/238,471 filed May 5, 1994 now U.S. Pat. No. 5,409,148, which was a continuation of U.S. Ser. No. 07/840,795 filed Feb. 24, 1992, now U.S. Pat. No. 5,310,095 and of U.S. Ser. No. 08/327,111 filed Oct. 21, 1994 now abandoned, which is a continuation of U.S. Ser. No. 08/216,155 filed Mar. 22, 1994 now U.S. Pat. No. 5,450,983 the subject matter of which is incorporated herein by reference.

TECHNICAL FIELD

The present invention relates to the art of spray texturing, and more particularly to an apparatus and method by which spray texturing can be accomplished to provide spray patterns of varying texture (i.e. with either finer or more coarse particle size).

BACKGROUND OF THE INVENTION

When drywall panels are installed in a building, and the seams taped, prior to painting the wall surface, there is often applied a spray texture, which is followed by painting. The spray texture will provide a desirable background pattern, and also obscure some of the seams that might appear in the drywall surface.

There are in the prior art various spray texturing tools or devices which utilize pressurized air to spray the texture material onto the wall surface. Some of these use compressed air as the gaseous medium to spray the textured material, with the pressurized air being derived from a remote source that feeds the air through a hose to the tool. There are also tools which are totally handheld, with the pressurized air being produced by manually reciprocating the piston of an air pump that is built into the tool.

When an existing drywall surface is being repaired, quite often a small section of drywall will be removed and another piece of drywall put in its place. The seams of this piece of drywall must then be taped, and (if the surrounding surface is textured) then have a texture surface treatment that would make it match with the surrounding drywall surface. It is, of course, desirable to have the spray pattern on the patch match that of the surrounding surface.

Also, when a rather small "patch" of drywall is to be spray textured, there is the matter of convenience. One approach has been simply to provide the spray texture material in an aerosol can, and the textured material is dispensed directly from the can to be sprayed onto the drywall surface. However, one of the considerations is how this can be accomplished in a manner to provide proper matching of the texture with that which is on the surrounding drywall.

U.S. Pat. No. 5,037,011 (Woods) discloses such an aerosol texture spraying device where the spray texture material is dispensed directly from the nozzle of the aerosol can. In a commercial embodiment of a device such as this, when there is higher pressure in the container, there is a relatively fine spray pattern. For a more coarse pattern (i.e. with larger particle sizes), the can is inverted and the nozzle depressed to dispense a certain amount of the propellant gas for a few seconds. Then the can is turned upright and the spray texture material dispensed at a lower pressure to provide the spray pattern with larger particle sizes.

U.S. Pat. Nos. 5,310,095 and 5,409,148 issued to the present Applicant disclose an apparatus for discharging a spray texture material through a nozzle means having a nozzle discharge opening to dispense this material. There is further provided a first delivery tube means having a first discharge passageway of a first predetermined cross-sectional area. The material discharge apparatus is operated to cause the texture material to be discharged through the tube means. The tube means has been found to maintain the quality of the texture spray pattern for longer spray durations.

If a different texture pattern is desired, a second discharge tube means may be positioned to receive material from the discharge nozzle means, and this second tube means has a second discharge passageway with a second predetermined cross-sectional area different from the first cross-sectional area. A finer spray pattern is obtained by utilizing a tube means with a passageway having a lesser cross-sectional area, and a coarse pattern is obtained by discharging said material through the tube means having a greater cross-sectional area.

One problem with the methods disclosed in the '095 and '148 patterns is that a plurality of parts must be manufactured, shipped, sold, assembled and stored by the end user in order to maintain the capability of the product to create different texture patterns. In particular, three straws must be sold in connection with the aerosol can. While this method is quite inexpensive from a manufacturing point of view, the shipping and sale of the product are somewhat complicated by the need to attach the three straws to the aerosol can. Further, the end user must install the straws into the actuating member of the aerosol can; this is difficult to accomplish without depressing the actuating member and discharging some of the texture material. Also, after the product is used, the user must store the straws such that they are easily available when needed.

In U.S. patent application Ser. No. 08/321,559, it was proposed that the aerosol device include: (a) a container for containing pressurized texture material; (b) a nozzle passageway; (c) a valve assembly for allowing the operator to create a path by which texture material may flow from the container into the nozzle passageway; and (d) an outlet member having a plurality of dispensing passageways formed therein.

The outlet member is arranged adjacent to the dispensing passageway in a manner that allows the user easily to align one of the dispensing passageways with the nozzle passageway. The dispensing passageways are of differing cross-sectional areas. Therefore, by arranging a selected one of dispensing passageways with the nozzle passageway, the texture pattern formed by the texture material on the surface may be varied in a manner similar to that disclosed in the '095 and '148 patents.

While the device disclosed in the '559 application is in one sense easier to use than the device disclosed in the '095 and '148 patents because separate parts need not be manufactured, sold, and stored with the device, the difficulty of including an elongate passageway in the outlet member of the '559 device yields a less satisfactory spray pattern than that provided by the '095 and '148 devices.

In particular, devices employing straws having elongate dispensing passageways yield more consistent spray patterns for longer periods of time than those without elongate dispensing passageways. The need thus exists for an aerosol spray texture device that does not require the manufacture, sale, or storage of separate pieces while at the same time providing a desirable spray pattern.

A problem with the methods disclosed in the '095 and '148 patents and the '559 application is that products embodying these patents contain hydrocarbon gasses that must be disposed of after the container is empty. The hydrocarbon liquids employed as a propellant provide improved spray patterns, however, because this material continues to expand as the texture material leaves the container, thereby atomizing the texture material to form a fine spray rather than a stream. An aerosol device for applying texture material to a surface such as a wall that does not contain hydrocarbon gasses but still yields acceptable spray patterns would be highly desirable.

Accordingly, the need exists for a spray texturing device that is easy to use, inexpensive to manufacture, does not require user assembly, does not require the shipment and storage of a plurality of parts, provides a predictable spray pattern for long periods of time, and does not employ hydrocarbons.

OBJECTS OF THE INVENTION

From the foregoing, it should be apparent that one object of the present invention is to provide improved apparatus and methods for applying spray texture material to a patch in a wall or the like.

Another object of the present invention is to provide a spray texturing apparatus having a favorable balance of the following characteristics:

a. inexpensively manufactured;

b. does not require manufacture, shipment, sale, and storage of an excessive number of separate components;

c. obviates the need for the end user to assemble several parts together;

d. does not employ hydrocarbon materials as a propellant; and e. yields a consistent spray pattern for longer valve opening periods.

SUMMARY OF THE INVENTION

These and other objects are obtained by the present invention, which is an aerosol system for dispensing texture material for application to a wall surface or the like comprising: (a) a container for containing texture material and propellant material; (b) a pouch that divides the container into first and second chambers, the texture material being contained in the first chamber and the propellant material being contained in the second chamber; (c) a nozzle passageway; and (d) a valve assembly for allowing the operator to create a path by which texture material may flow from the container into the nozzle passageway.

With this arrangement, the propellant material may be a pressurized inert gas such as air or nitrogen that does not cause disposal problems, although liquid hydrocarbons may also be used. Further, the pouch prevents the propellant material from being expelled from the container when the container is inverted.

With such a pouch separating the propellant from the texture material, however, the texture material does not contain liquid hydrocarbons that gasify as the texture material leaves the dispensing passageway to cause the texture material to be dispensed in a fine spray; to the contrary, with a standard cylindrical dispensing passageway, the texture material is dispensed in a stream that may be inappropriate for the application of the texture material to a wall surface or the like.

The present invention thus additionally comprises providing a outlet member defining one or more outlet passageways. Each outlet passageway is configured such that: (a) the texture material is mixed with air using the venturi effect to atomize the texture material as it is expelled to form an appropriate spray; and/or (b) the walls defining the outlet passageway deflect the texture material as it is expelled such that the texture material forms a spray pattern appropriate for applying the texture material to the wall surface. In either case, the spray pattern is developed without the benefit of gasifying liquid hydrocarbons mixed with the texture material as it is dispensed.

In one form, the present invention comprises providing an outlet member having a plurality of outlet passageways. Each outlet passageway is sized and configured to deflect the texture material passing therethrough. However, each of the passageways is different from the others to provide differing texture spray patterns.

The invention may, in another form, comprise: (a) a container for containing a spray mixture comprising texture material and a liquid hydrocarbon propellant; (b) a nozzle passageway; (c) a valve assembly for allowing the operator to create an exit path by which texture material may flow from the container into the nozzle passageway; (d) an outlet member having a plurality of dispensing passageways formed therein; and (e) a restriction structure located in the exit path prior to the nozzle passageway.

The outlet member is arranged adjacent to the dispensing passageway in a manner that allows the user easily to align one of the dispensing passageways with the nozzle passageway. The dispensing passageways are of differing cross-sectional areas. The restriction structure resists passage of the spray mixture along the exit path.

Such a device including a restriction structure allows a reduction in the number of parts that must be manufacture, shipped, stored, and used, as described in the '559 application, but, the Applicants believe, provides the same improved spray texture patterns associated with the elongate passageways of the '095 and '148 patents.

Further objects and advantages of the present invention will become apparent from the following detailed description.

BRIEF DESCRIPTION OF THE DRAWING

FIG. 27 is a perspective view of another exemplary spray texturing apparatus constructed in accordance with, and embodying, the principles of the present invention;

FIG. 28 is a partial cut-away view taken along lines 28—28 in FIG. 27;

FIG. 29 is a perspective view of another exemplary spray texturing apparatus constructed in accordance with, and embodying, the principles of the present invention;

FIG. 30 is a partial cut-away view taken along lines 30—30 in FIG. 29;

DETAILED DESCRIPTION

Figure 1:
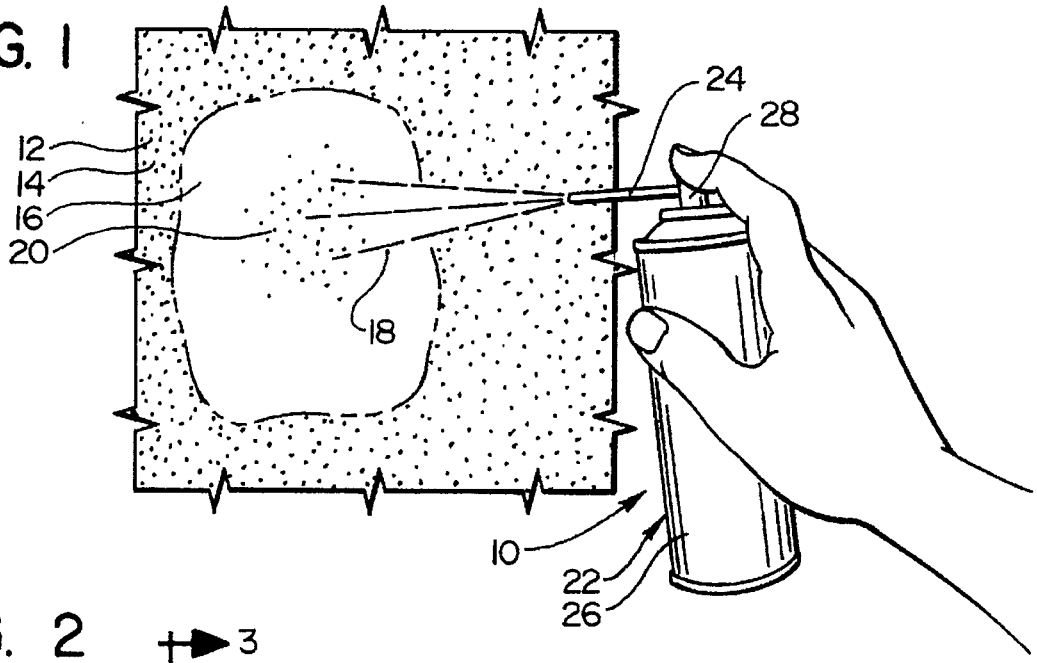
FIG. 1 is an isometric view illustrating a preferred embodiment of the present invention applying a spray texture material to a patch on a drywall surface.

In FIG. 1, there is shown the apparatus 10 of the present invention being used in spraying the texture material onto a section of wallboard 12 having a previously sprayed surface portion 14 surrounding an unsprayed portion 16 which could be, for example, a more recently applied piece of wallboard that serves as a "patch". The spray itself is indicated at 18, and the spray material deposited on the wall portion 16 as a sprayed texture is indicated at 20.

Figure 2:
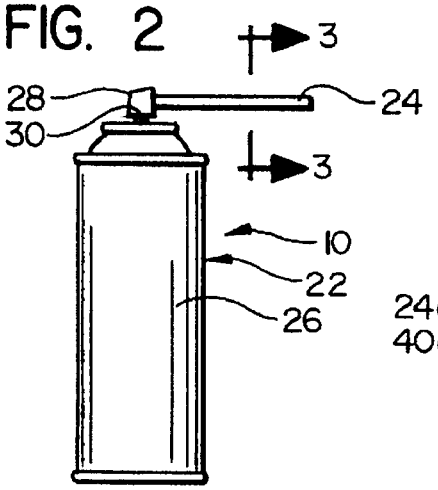
FIG. 2 is a side elevational view of the apparatus of the present invention.

With reference to FIG. 2, the present invention is shown being incorporated with an aerosol spray containing device 22, the basic design of which is or may be conventional in the prior art. Used in combination with this container 22 is a dispensing tube 24 which is a critical feature of the present invention. More particularly, it has been found by utilizing this dispensing tube 24 in particular arrangements to discharge the spray texture material, more precise control of the spray texture pattern can be achieved. Further, there are other advantages, in that not only is a more controllable spray pattern achieved, but this consistency of the spray pattern can be accomplished for a relatively long period of use. In other words, even after a substantial amount of the spray texture material has been already discharged from the aerosol dispensing container 22, the spray pattern remains rather consistent. The manner in which this is achieved will be described more fully later herein.

It is recognized that in the prior art tubular members have been used in combination with an aerosol spray can to deliver a material, such as a lubricant. To the best knowledge of the applicants, however, this use has been primarily to enable the aerosol container to deliver the fluid, such as a lubricating oil, to a somewhat inaccessible location, and not to achieve the ends of the present invention.

To return to our description of the aerosol dispensing device 22, as indicated above, the basic design is or may be conventional. As shown herein, the device 22 comprises a cylindrical container 26 and a dispensing nozzle member 28 positioned at the top of the container 26. As is common in the prior art, this dispensing member 28 in its upright position blocks flow of material from the container 26. This dispensing member 28 is attached to a downwardly extending stem 30, and when the member 28 is depressed, a valve opens within the container 22 so that the material in the container 22 flows upwardly through the stem 30 and laterally out a nozzle formed in the dispensing nozzle member 28. Since the manner in which this is achieved is well known in the prior art, this will not be described in detail herein.

Figure 16:
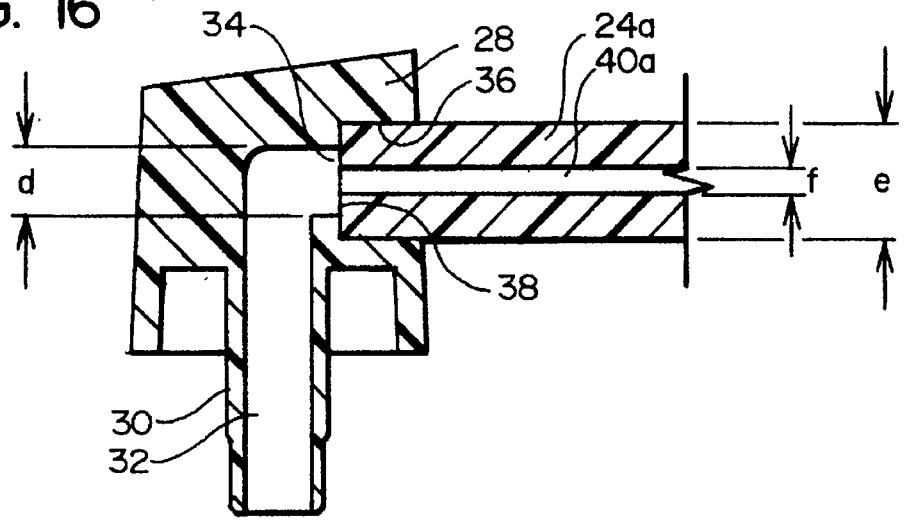
FIG. 16 is a cross sectional view taken through the dispensing head of the aerosol container, with this plane being coincident with the lengthwise axis of the dispensing tube and the vertical axis of the dispensing head, showing only the discharge orifice portion of the dispensing head, and further with the smaller inside diameter tube shown in FIG. 3.
Figure 17:
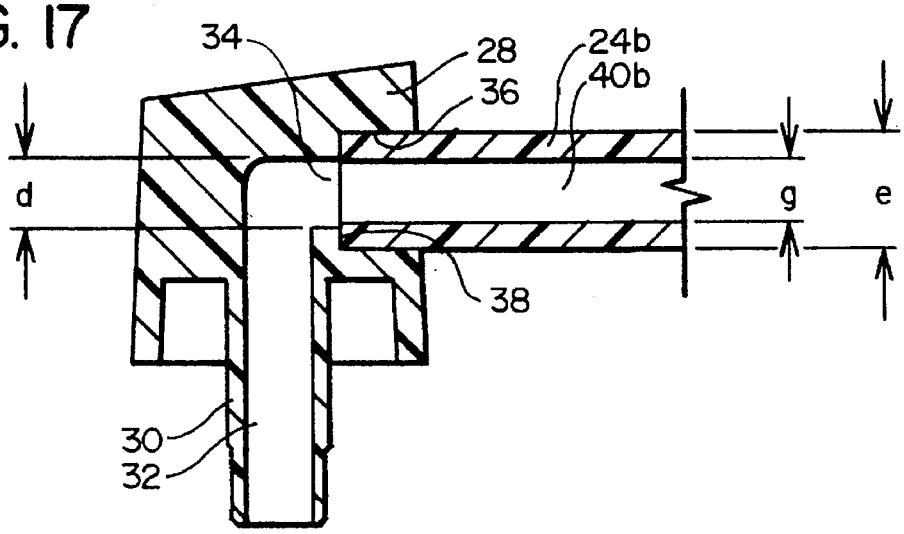
FIG. 17 is a view similar to FIG. 16, but showing the dispensing head having the medium inside diameter tube of FIG. 5 positioned therein.
Figure 18:
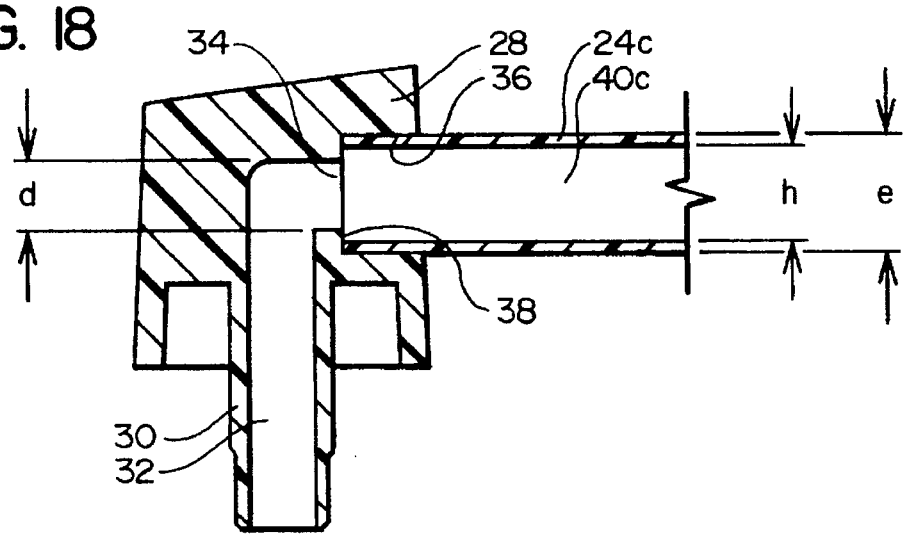
FIG. 18 is a view similar to FIGS. 16 and 17, but showing the dispensing tube of FIG. 7 having the largest inside diameter, as shown in FIG. 7.

Reference is now made to FIGS. 16 through 18, and it can be seen that the stem 30 provides a passageway 32 through which the spray texture material flows upwardly, and then is directed laterally to be discharged through a lateral nozzle opening 34. The passageway 32 and nozzle 34 can have their dimensions and configuration optimized for proper performance, and the manner in which this is done is also known in the prior art.

In the present invention, the nozzle member 28 is provided with a counterbore 36 having a moderately enlarged diameter, relative to the diameter of the nozzle opening 34. Both the nozzle opening 34 and the counterbore 36 have a cylindrical configuration. The dispensing tube 24 has an outside diameter so that its end portion is able to fit snugly within the counterbore 36, with the end surface of the tube 34 bearing against the forwardly facing annular shoulder 38 defined by the counterbore 36 with the nozzle opening 34.

Figure 3:
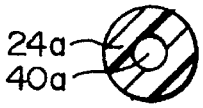
FIG. 3 is a sectional view taken along 3—3 of FIG. 2, this being done to illustrate the inside diameter of the discharge tube which is made relatively small to provide a spray texture pattern of a more fine particle size.
Figure 7:
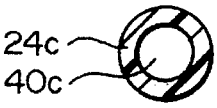
FIGS. 7 and 8 are similar to FIGS. 3 and 4, respectively, with FIG. 7 showing the cross section of a discharge tube of yet larger inside diameter for the flow passageway, and FIG. 8 showing the spray pattern with a yet larger particle size.

In the preferred embodiment of the present invention, a plurality of dispensing tubes 24 are provided, and in the present embodiment, there are three such tubes, 24*a*, 24*b* and 24*c*. It can be seen from examining FIGS. 3, 5 and 7 (and also FIGS. 16, 17 and 18) that the outside diameter of all three tubes 24*a*, 24*b*, and 24*c* have the same outside diameter, but different inside diameters for the discharge passageway 40.

Figure 4:
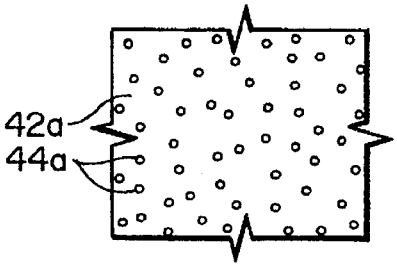
FIG. 4 illustrates somewhat schematically a spray texture pattern in a wall surface which has relative fine particle size.

It has been found that by selecting different diameters for the discharge passageway 40, the spray texture pattern can be controlled more accurately. With the smaller diameter 40*a* of the discharge tube 24*a*, shown in FIG. 3, a relatively fine spray texture pattern can be achieved, as shown in FIG. 4, where the particles of spray texture material are of a small particle size, as shown in the wall section 42*a*.

Figure 5:
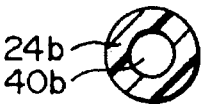
FIGS. 5 and 6 are views similar to FIGS. 3 and 4, with FIG. 5 showing a discharge passageway of a larger inside diameter, and FIG. 6 showing the spray pattern with a larger particle size.
Figure 8:
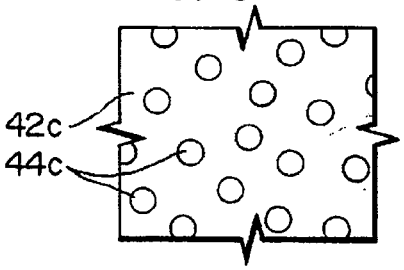

In FIG. 5, the interior discharge passageway 40*b* is of a more intermediate size, and this results in a discharge pattern which has a somewhat larger particle size, as shown in the wall section 42*b*. Then, with the yet larger diameter discharge opening 40*c*, as can be seen in FIG. 8, the wall section 42*c* having a spray texture pattern with a yet larger particle size. The particles of the board section 42*a*, 42*b*, and 42*c* are designated as, respectively, 44*a*, 44*b* and 44*c*.

With regard to the spray texture material itself, if has been found that quite desirable results can be achieved where the basic composition of the spray texture material comprises a resin or resins, particulate filler material and a propellant. Also, there is a solvent, and desirably dryers to accelerate the drying reaction of the resin with oxygen.

More specifically, the resin or resins desirably comprise alkyd resins, and more specifically those which are generally called bodying alkyds or puffing alkyds. Such alkyds are sometimes used for what are called "architectural coatings". The resins are made somewhat more gelatinous than would be used in other applications, this depending upon the spray characteristics that are desired. If the alkyd resins are made more gelatinous or viscous, a coarser spray pattern would be expected for a particular set of conditions.

The particulate filler material desirably has various particle sizes, and this can be a filler material or materials which are well known in the prior art, such as calcium carbonate, silica, talc, wollastonite, various types of pigments, etc.

The propellant is desirably a liquefied hydrocarbon gas, with this liquefied gas being dispersed throughout the texture material composition, such as being dissolved therein or otherwise dispersed therein. The propellant is characterized that under the higher pressure within the container the propellant remains dispersed or dissolved as a liquid throughout the spray texture material, and upon release of pressure, the propellant begins going back to its gaseous form to act as a propellant and push the material up the stem passageway 32 and out the nozzle opening 34.

The solvent is desirably aromatic and/or aliphatic hydrocarbons, ketons, etc.

The dryer or dryers would normally be metallic dryer, such as various metal salts. These are already well known in the art, so these will not be described in detail herein.

It has been found that this type of texture material can be sprayed by using the present invention to provide a reasonably consistent spray texture for a given configuration of the tube 24. Also, it has been found that this consistency of spray pattern can be accomplished throughout the discharge of the great majority of the spray texture material within the container 26.

With regard to the particular dimensions utilized in this preferred embodiment of the present invention, reference is made to FIGS. 16 through 18. The diameter "d" of the nozzle orifice 34 is in this particular embodiment 0.102 inch, and the diameter of the counterbore (indicated at "e") is 0.172 inch; the diameter "f" of the passageway 40*a* (i.e. the smallest diameter passageway) is 0.050 inch; the diameter "g" of the intermediate sized passageway 40*b* (see FIG. 17) is 0.095 inch; and the diameter "h" of the largest tube passageway 40*c* is 0.145 inch.

Thus, it can be seen in the arrangements of FIGS. 16 through 18 that in FIG. 16, there is a substantial reduction in the cross-sectional area of the passageway 40*a*, with this having about one half the diameter of the nozzle opening 34, so that the passageway area 40*a* is about one quarter of the nozzle opening 34.

In the intermediate size of FIG. 17, the diameter and cross-sectional area of the passageway 40*b* (indicated at "g") is nearly the same as that of the nozzle 34.

In FIG. 18, the diameter of the passageway 40*c* (indicated at "h") is slightly less than one and one half of the nozzle opening 34, and the cross sectional area is about twice as large.

Figure 9:
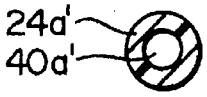
FIGS. 9, 10 and 11 correspond to, respectively, FIGS. 3, 5 and 7 and show a different arrangement of discharge tubes where the outside diameter varies.
Figure 10:
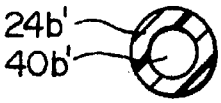
Figure 11:
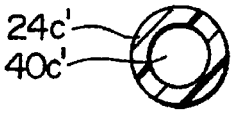

FIGS. 9, 10 and 11 show an alternative form of the tubes 24*a–c*, and these tubes in FIGS. 9 through 11 (designated 24*a'*, 24*b'* and 24*c'*) have the same internal passageway cross-sectional area as the passageways 24*a*, 24*b* and 24*c*, respectively, but the outside diameter of these are made smaller, relative to the passageway size. If there is such varying outside diameters, then a plurality of mounting collars could be used, with these having consistent outside diameters, but varying inside diameters to fit around at least the smaller tubes of FIGS. 9 and 10.

Figure 12:
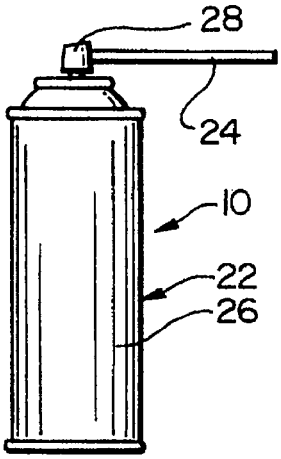
FIGS. 12, 13 and 14 illustrate the apparatus having tubes 24 of different lengths.
Figure 13:
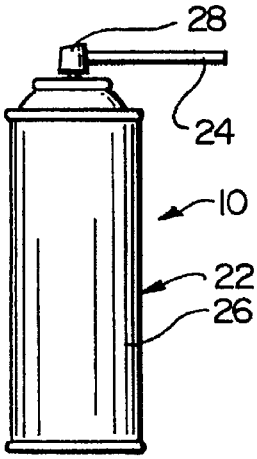
Figure 14:
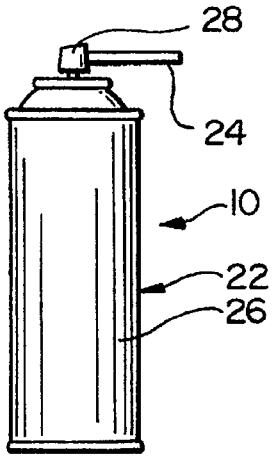

FIGS. 12 through 14 are simply shown to illustrate that the length of the tube 24 can be varied. It has been found that a rather desirable length of the tube 24 is approximately four inches. While a longer tube length could be used, in general there is no particular advantage in doing so since the proper consistency can be obtained with a tube of about four inches. Also, experiments have indicated that the length of the tube 24 can be reduced lower than four inches, possibly to two inches and even as low as one inch) without causing any substantial deterioration of the consistency and quality of the formation of the spray pattern. However, it has been found that somewhat more consistent results can be obtained if the length of the tube 24 is greater than one inch and at least as great or greater than two inches.

A tube length as short as one half inch has been tried, and this is able to provide a substantial improvement of performance over what would have been obtained simply by discharging the spray texture directly from the nozzle opening 34, without any tube, relative to controlling spray pattern. The shorter tube 24 (as small as one half inch) provides a significant benefit, but not the full benefit of the longer tube 24. The very short tube (e.g. one half inch) has a lesser quality of performance when used with the larger diameter passageway 40 than with the smaller passageway.

Figure 15:
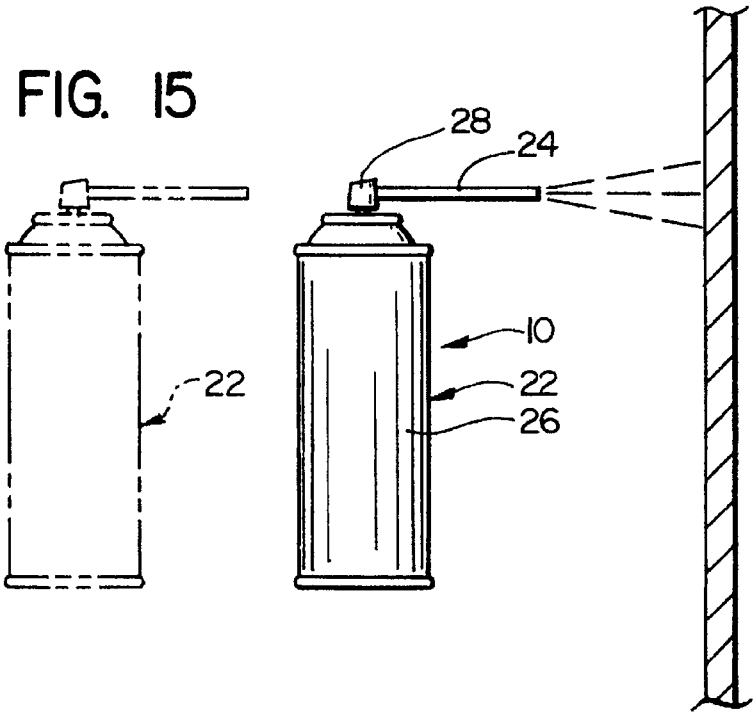
FIG. 15 is a side elevational view of the apparatus as shown being positioned closer to or further from a wall surface.

FIG. 15 illustrates that the texture pattern can also be controlled to some extent by moving the apparatus 10 closer to or farther away from the wall surface. If the apparatus 10 is moved rather close to the wall surface, the density of the applied material is increased for a given time of exposure. It has been found that in general satisfactory results can be obtained if the apparatus 10 is held approximately three feet from the wall surface. However, this will depend upon a number of factors, such as the pressure provided by the propellant, the character of the spray texture material, and other factors.

To describe now the operation of the present invention, an aerosol dispensing device 22 is provided as described previously herein with the spray texture material contained within the can 26 at a desired pressure. As is common with aerosol cans, it is desirable to shake the device 22 for a few seconds prior to depressing the nozzle control member 28.

If a relatively fine texture is desired, then a smaller diameter tube such as at 24*a* is used. For spray texture patterns having larger particle size, the larger diameter tube is used.

The person directs the nozzle opening 34 and the tube 24 toward the wall surface to be sprayed and depresses the nozzle member 28. As the spray texture material is discharged, the container 26 is moved back and forth and is tilted to different angles to spray the desired area.

As indicated earlier, it has been found that not only can a "fineness" or "coarseness" (i.e. smaller particle size or larger particle size, respectively) be controlled with reasonable precision by the present invention, but this consistency of the spraying pattern can be maintained throughout the discharge of the great majority of the spray material within the container 26. While these phenomena are not totally understood, it is believed that the following can be reasonably hypothesized to provide at least a partial explanation.

First, the separation of the texture material into particles of smaller or larger size is due in part to the character of the material itself, and also due in part to the way the forces are exerted on the material to tend to break it up into particles. More particularly, it can be hypothesized that if there is a greater shear force tending to separate the particles, it would be expected that there would be a finer pattern.

It is also recognized that when a fluid is moving through a conduit or tube, there is commonly what is called a velocity gradient along a transverse cross section of the flow of material. More precisely, the material immediately adjacent to the wall surface may have a very low velocity or practically no velocity. The adjacent material just a small distance away from the wall will have a somewhat greater velocity, but will still be retarded significantly due to the shear force provided by the material that is closer to the wall surface. As the cross section of the liquid material is analyzed closer toward the center, the shear force becomes less and the velocity becomes more uniform.

With the foregoing in mind, it also has to be recognized that if the diameter of the tube or conduit is reduced by one half, the cross-sectional area is reduced by one quarter. Thus, for the smaller tube (i.e. one half diameter) the surface area that provides a retarding force is doubled relative to the volume of flow at the same velocity). This would indicate that for a given cross-sectional segment of the fluid material being discharged, there is relatively greater shear force exerted for the smaller inside diameter tube. This would lead to the conclusion that for the discharge of a given amount of fluid at a certain velocity and at the same pressure, there would be a smaller particle size than if a tube of greater inside diameter were used.

Another phenomenon to be considered is with regard to the pressure which is forcing the textured material out of the tube 24. It can be surmised that if the pressure is greater, the velocity of the material traveling through the tube 24 would be greater, so that the shear forces exerted on the texture material would be greater so that smaller particle sizes would result.

It can be seen in FIG. 16 that the relatively small diameter passageway 40*a* serves as a restriction for the material flowing out the nozzle 34. This would tend to cause the velocity of the material flowing up the stem passageway 32 and out the nozzle opening 34 to decrease to some extent, but to have a relatively higher velocity out the passageway 40*a*. Further, it can be expected that the pressure of the propelling gas in the passageway 40*a* would be somewhat higher than if a larger diameter passageway such as 40*b* or 40*c* were utilized. Experimental results using different size tubes seem to verify this conclusion.

In FIG. 17, the diameter and cross-sectional area of the passageway 40*b* is nearly the same as that of the nozzle opening 34. Therefore it can be surmised that the velocity and pressure in the passageway 40*b* would be somewhat less than in the passageway 40*a*, this resulting in a somewhat larger particle size, and also a somewhat lower discharge velocity. Experimental results have verified this also.

Finally, with reference to FIG. 18, when the passageway diameter is larger than that of the nozzle opening 34 (as it is with the passageway 40*c*), it can be expected that the fluid discharged from the nozzle 34 would have a lower velocity and that there would be a lower propelling force provided by the propellant. Experimental results have indicated that this results in the coarser particle size.

However, it has to be recognized that while the above hypothesis can be proposed with reasonable justification, there are likely other phenomena involved which the applicants are either not aware of or have not fully evaluated. For example, with the propellant being disbursed in (and presumably dissolved in) the texture composition, it can be surmised that this propellant continues to go out of solution or dispersion into its gaseous form and expand to provide the propellant force, and this continues as the quantity of texture material continues to be reduced. This may also have a desirable effect on the formation of the particles and of the particle size, relative to consistency.

Nevertheless, regardless of the accuracy or correctness of the above explanations, it has been found that with the present invention, the spray pattern (and more particularly the particle size of the spray pattern) can be achieved with greater consistency and within relatively greater limits of particle size, than the prior art devices known to the applicants. Further, the consistency of the spray pattern can be maintained for the discharge of a large proportion of spray texture material from the apparatus 10.

It is to be recognized, of course, that various relative dimensions could be changed without departing from the basic teachings of the present invention. For example, it has been found that with spray texture material of a character which are acceptable in present day use, that a range of tube inside diameters of approximately one half of a tenth of an inch to one and one half tenth of an inch would give a reasonable range of texture spray patterns. However, it can be surmised that tube diameters outside of this range (e.g. one quarter of a tenth of an inch to possibly as high as one quarter of an inch would also provide acceptable texture spray patterns, depending upon a variety of circumstances, such as the viscosity and other characteristics of the spray texture material itself, the discharge pressure, the volumetric rate at which the spray texture material is delivered to the tube 24, and other factors.

Figure 19:
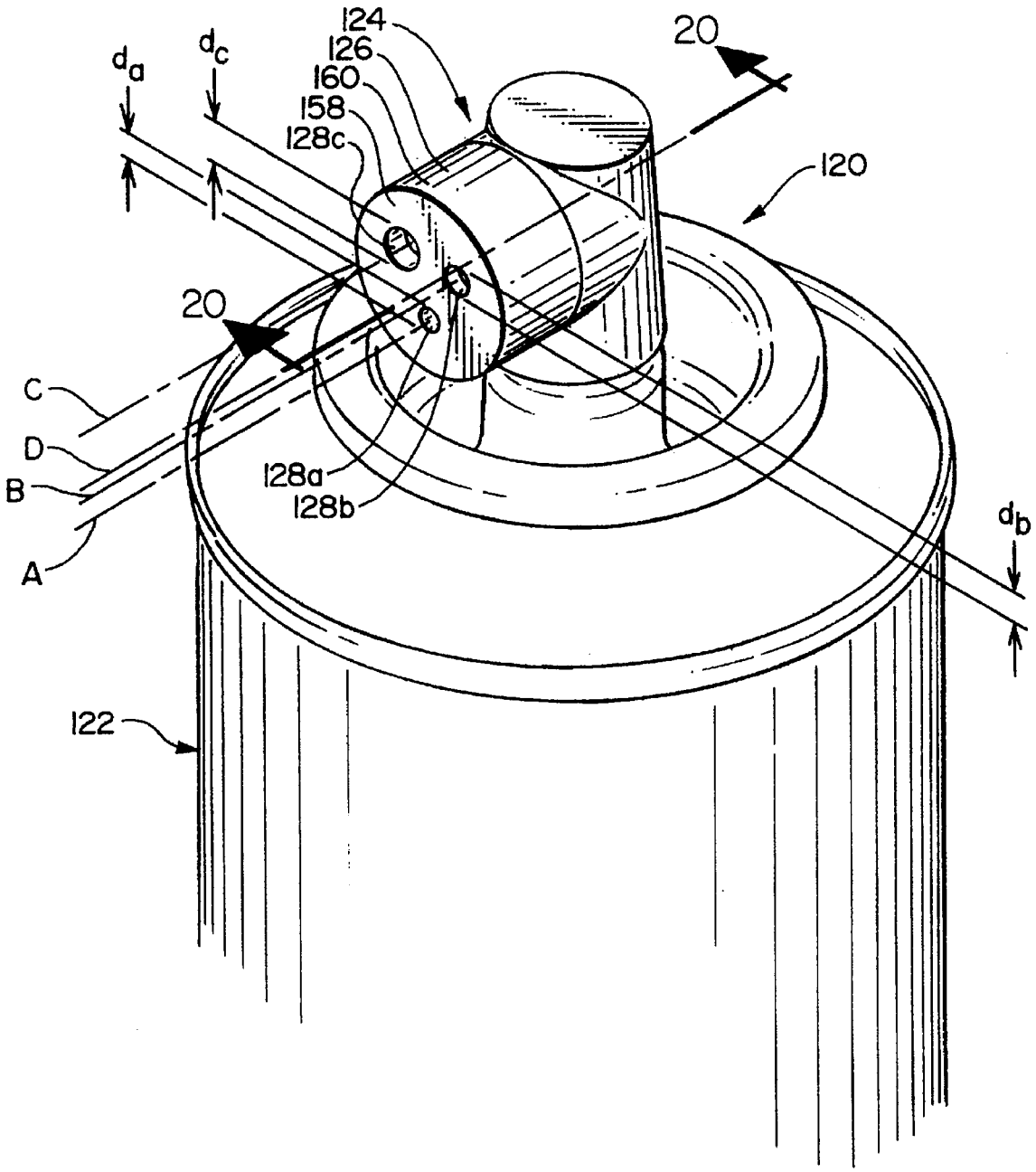
FIG. 19 is a perspective view of another exemplary spray texturing apparatus constructed in accordance with, and embodying, the principles of the present invention.
Figure 20:
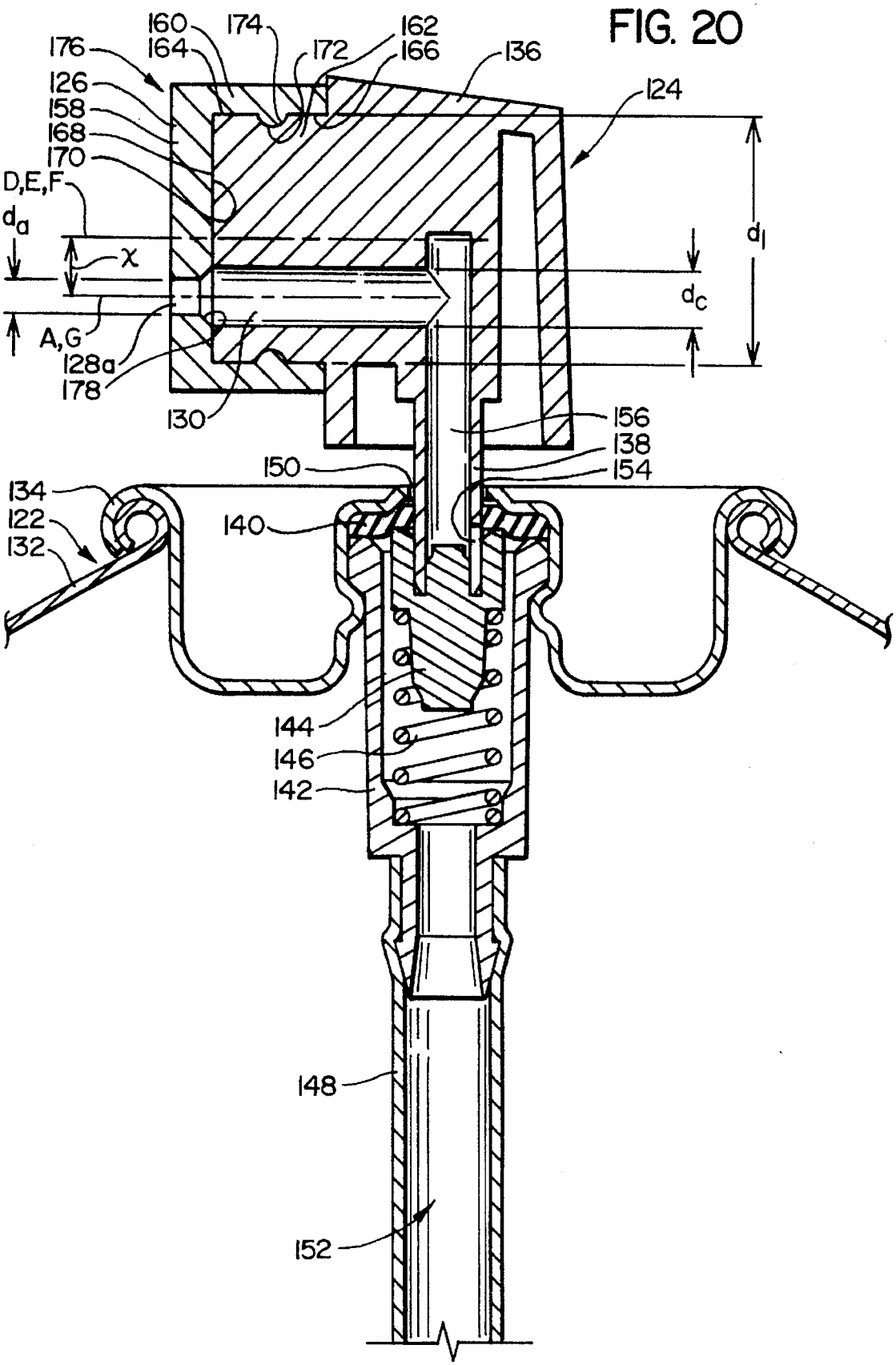
FIG. 20 is a partial cut-away view taken along lines 20—20 in FIG. 19.

Referring now to FIGS. 19 and 20, depicted therein at 120 is another exemplary spray texturing apparatus constructed in accordance with, and embodying, the principles of the present invention. The spray texturing apparatus 120 basically comprises an aerosol container 122, a valve assembly 124 mounted on the container 122, and an outlet member 126 attached to the valve assembly 124.

The outlet member 126 has first, second, and third outlet orifices 128*a*, 128*b*, and 128*c* formed therein. As shown in FIG. 19, these outlet orifices 128*a*, 128*b*, and 128*c* have of different diameters. Further, the outlet member 126 is so attached to the valve assembly 124 that each of the orifices 128*a*, 128*b*, and 128*c* aligned with a nozzle passageway 130 of the valve assembly 124 through which the texture material is dispensed or discharged. Aligning the orifices 128*a*, 128*b*, and 128*c* as just-described effectively extends the length of the nozzle passageway 130 in a manner that allows the operator to vary the cross-sectional area of a discharge opening 131 through which the texture material is discharged.

To operate the spray texturing apparatus 120, the valve assembly 124 is operated to allow the spray material within the container 122 to pass through the nozzle passageway 130. The texture material thus exits the spray texturing apparatus 120 through whichever of the outlet orifices 128*a*, 128*b*, or 128*c* is aligned with the nozzle passageway 130.

Figure 6:
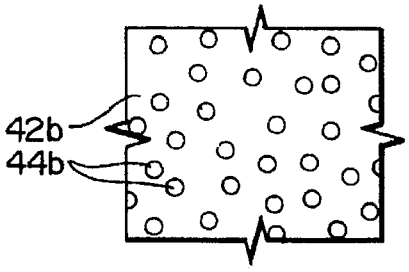

As shown in FIG. 20, the nozzle passageway 130 has a diameter of $d_o$. Similar to the dispensing tubes 24*a*, 24*b*, and 24*c* described above, the outlet orifices 128*a*, 128*b*, and 128*c* of different diameters $d_a$, $d_b$, and $d_c$ result in different spray texture patterns 20 being applied to the wallboard 12. One of the outlet orifices 128*a*, 128*b*, and 128*c* is selected according to the type of texture pattern desired and arranged to form a portion of the nozzle passageway 130, thereby varying the effective cross-sectional area of the discharge opening 131. The outlet orifice 128*a* is of the smallest diameter and results in a spray pattern having the small particles 44*a* as shown in FIG. 4. The outlet orifice 128*b* is of medium diameter and results in a spray pattern having the somewhat larger particles 44*b* shown in FIG. 5. The outlet orifice 128*c* is of the largest diameter, which results in a spray pattern having the large particles 44*c* shown in FIG. 6.

The spray texturing apparatus 120 obtains the same basic result as the apparatus 10 described above and the prior art assembly shown in FIGS. 27 and 28; however, as will be apparent from the following discussion, the apparatus 120 allows a reduction in the number of parts employed to achieve this result and substantially eliminates the possibility that individual parts will be lost by the end user. Also, the apparatus 120 is completely assembled at the factory and thus alleviates the potential for the operator to be sprayed with texture material during assembly.

Referring again to FIG. 20, the operation of the spray texturing apparatus 120 will now be described in further detail. The container 122 basically comprises a generally cylindrical base 132 and a cap 134. The base 132 and cap 134 are conventional and need not be described herein in detail.

The valve assembly 124 basically comprises: (a) the outlet member 128 described above; (b) an actuator member 136 having a valve stem 138; (c) a valve seat 140; (d) a valve housing 142; (e) a valve member 144; (f) a valve spring 146; and (g) a collection tube 148 that extends into the spray material within the container 122. Essentially, the valve assembly 124 creates a path that allows the pressure within the container 122 to cause the texture material to flow through the nozzle passageway 130.

The valve assembly 124 is constructed and operates basically as follows. The valve seat 140 and valve housing 142 mate with and are held by the container cap 134 near a valve hole 150 in the cap 134. The valve member 144 and valve spring 146 are mounted within the valve housing 142 such that the valve spring 146 urges the valve member 144 towards the valve seat 140. The valve stem 138 extends through the valve hole 150 and is attached to the valve member 144; pressing the actuator member 136 towards the container 122 into an open position forces the valve member 144 away from the valve seat 140 against the urging of the valve spring 146.

When the valve member 144 is forced away from the valve seat 140, an exit passageway 152 for the spray material is created. This exit passageway 152 allows the spray material to exit the apparatus 120 by passing: through the collection tube 136; through the center of the valve housing 142; around the valve member 144; through a slot 154 formed in the valve stem 138; through a vertical passageway 156 formed in the actuator member 136; through the nozzle passageway 130 described above; and through the one of the outlet orifices 128*a*, 128*b*, or 128*c* aligned with the nozzle passageway 130. At this point, the spray material forms the spray 18 as described above.

The exemplary outlet member 126 basically comprises a disc portion 158 and a cylindrical portion 160. The first, second, and third outlet orifices 128*a*, 128*b*, and 128*c* are formed in the disc portion 158. Center axes A, B, and C of the outlet orifices 128*a*, 128*b*, and 128*c* are equidistant from a center axis D of the disc portion 158; the distances between the center axes A, B, and C of these outlet orifices 128*a*, 128*b*, and 128*c* and the center axis D of the disc portion 158 are represented by the reference character X in FIG. 20.

The cylindrical portion 160 of the outlet member 126 has a center axis E which is aligned with the center axis D of the disc portion 158. Additionally, an outlet portion 162 of the actuator member 126 through which the nozzle passageway 130 extends has a generally cylindrical outer surface 164. A center axis F of the actuator member outer surface 164 is aligned with the center axes D and E described above.

Also, a center axis G of the nozzle passageway 130 is arranged parallel to the center axis F of the actuator member outer surface 164. The center axis G of this nozzle passageway 130 is spaced away from actuator member center axis F the same distance X that exists between the center axes A, B, and C of the nozzle exit orifices and the center axis D of the disc portion 158.

Finally, an inner surface 166 of the outlet member cylindrical portion 160 is cylindrical and has substantially the same diameter d, taking into account tolerances, as the cylindrical outer surface 164 of the outlet portion 162 of the actuator member 136. An outlet surface 168 of the outlet portion 162 is disc-shaped and has substantially the same diameter d as the outlet member inner surface 166 and the actuator member outer surface 164.

Accordingly, as shown in FIG. 20, the outlet member 126 is attached to the actuator member 136 by placing the cylindrical portion 160 of the outlet member 126 over the outlet portion 162 of the actuator member 136 such that the actuator member outlet surface 168 is adjacent to an inner surface 170 on the disc portion 158 of the outlet member 126.

When the outlet member 126 is so mounted on the actuator member 136, an annular projection 172 formed on the inner surface 166 of the outlet member cylindrical portion 160 engages an annular indentation 174 formed in the outer surface 164 of the actuator member outlet portion 162. The projection 172 and indentation 174 are arranged parallel to the actuator member outlet surface 168 and thus allow rotation of the outlet member 126 relative to the actuator member 136. Further, the engagement of the projection 172 with the indentation 174 prevents inadvertent removal of the outlet member 126 from the actuator member 136; however, both the projection 172 and indentation 174 are rounded to allow the outlet member 126 to be attached to and detached from the actuator member 136 when desired. The outlet member cylindrical portion 160, the projection 172, and indentation 174 thus form an attachment means 176 for rotatably attaching the outlet member 126 to the actuator member 136.

As shown in FIG. 20, when the outlet member 126 is attached to the actuator member 136, the center axes D, E, and F described above are aligned. Further, the outlet orifice center axes A, B, and C are parallel to the nozzle passageway center axis G. Accordingly, any one of these outlet orifice center axes A, B, and C can be aligned with the nozzle passageway center axis G by rotation of the outlet member 26 about the axes D, E, and F relative to the actuator member 136. In FIG. 20, the center axis A of the first outlet orifice 128*a* is shown aligned with the nozzle passageway center axis G.

FIG. 20 also shows that an intermediate surface 178 is formed at one end of the first exit orifice 128*a*. This intermediate surface 176 brings the diameter of the exit passageway 152 gradually down from a diameter $d_o$ of the dispensing passageway 130 to the diameter $d_a$ of the first exit orifice 128*a*. A similar intermediate surface exists at one end of the second exit orifice 128*b*. An intermediate surface is not required for the third exit orifice 128*c* as, in the exemplary apparatus 120, the diameter $d_c$ of the third exit orifice is the same as that of the diameter $d_o$ of the nozzle passageway 130.

Figure 21:
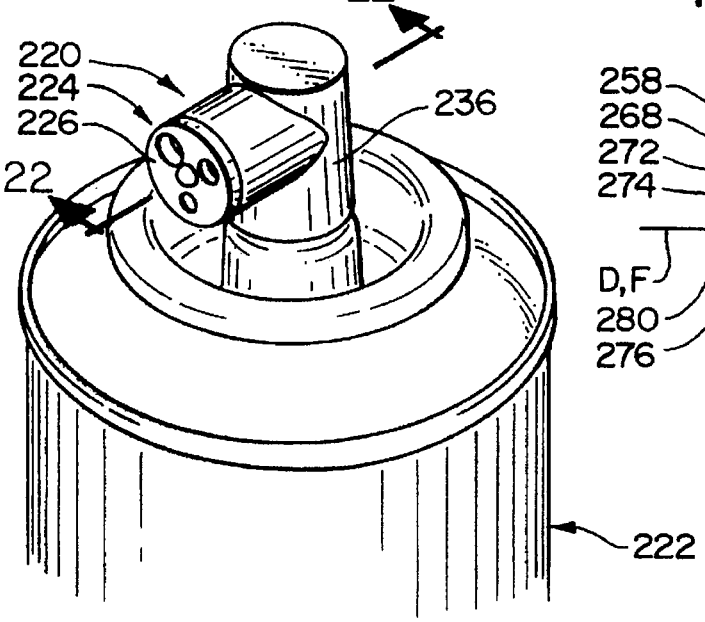
FIG. 21 is a perspective view of another exemplary spray texturing apparatus constructed in accordance with, and embodying, the principles of the present invention.
Figure 22:
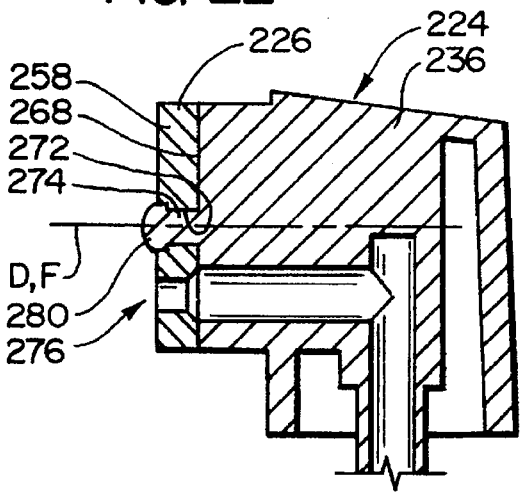
FIG. 22 is a partial cut-away view taken along lines 22—22 in FIG. 21.

Referring now to FIGS. 21 and 22, depicted therein at 220 is yet another exemplary spray texturing apparatus constructed in accordance with, and embodying, the principles of the present invention. The spray texturing apparatus 220 operates in the same basic manner as the apparatus 120 just-described; accordingly, the apparatus 220 will be described herein only to the extent that it differs from the apparatus 120. The characters employed in reference to the apparatus 220 will be the same as those employed in reference to the apparatus 120 plus 100; where any reference characters are skipped in the following discussion, the elements referred to by those skipped reference characters are exactly the same in the apparatus 220 as the elements corresponding thereto in the apparatus 120.

The spray texturing apparatus 220 basically comprises an aerosol container 222, a valve assembly 224 mounted on the container 222, and an outlet member 226 attached to the valve assembly 224. The valve assembly 224 further comprises an actuator member 236. The primary difference between the apparatus 120 and the apparatus 220 is in the construction of the outlet member 226 and the actuator member 236 and the manner in which these members 226 and 236 inter-operate.

In particular, the outlet member 226 simply comprises a disc portion 258. An attachment means 276 for attaching the outlet member 226 to the actuator member 236 basically comprises an indentation or hole 272 formed in the outlet member disc portion 258 and a projection 274 formed on an outlet surface 268 formed on the actuator member 236. The hole 272 and projection 274 lie along a center axis D of the disc portion 258 and a center axis F extending through the actuator member 236. The interaction of the hole 272 and the projection 274 allow the outlet member 226 to be rotated about the axes D and F. A rounded end 280 of the projection 274 prevents inadvertent removal of the outlet member 226 from the actuator member 236.

Accordingly, it should be clear from the foregoing discussion and FIGS. 21 and 22 that the attachment means 276 accomplishes the same basic function as the attachment means 176 described above and thus that the apparatus 220 operates in the same basic manner as the apparatus 120 described above.

Figure 23:
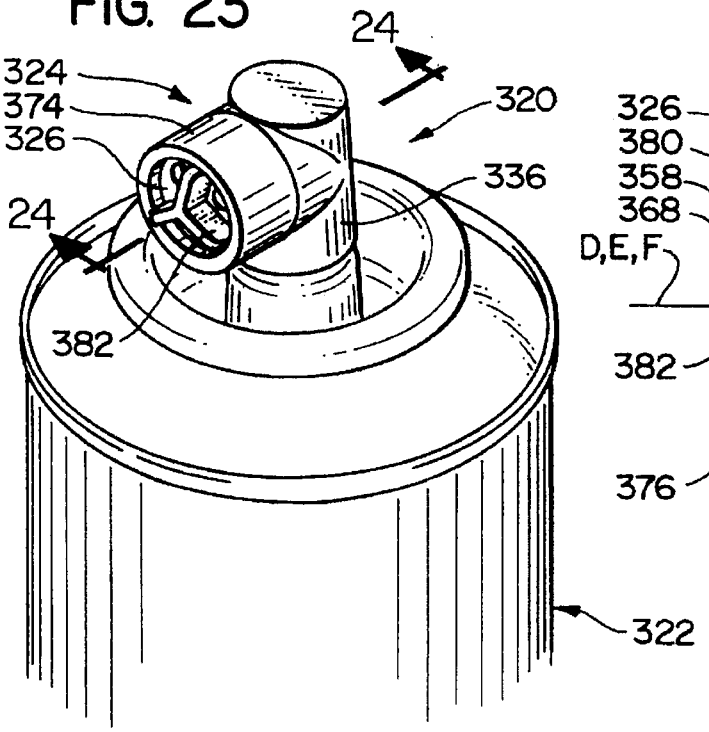
FIG. 23 is a perspective view of another exemplary spray texturing apparatus constructed in accordance with, and embodying, the principles of the present invention.
Figure 24:
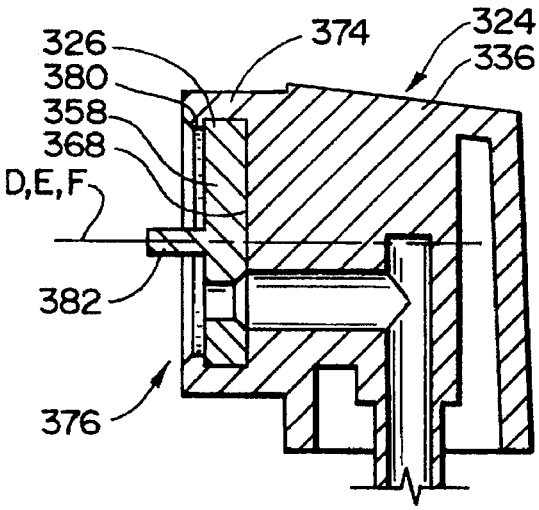
FIG. 24 is a partial cut-away view taken along lines 24—24 in FIG. 23.

Referring now to FIGS. 23 and 24, depicted therein at 320 is yet another exemplary spray texturing apparatus constructed in accordance with, and embodying, the principles of the present invention. The spray texturing apparatus 320 operates in the same basic manner as the apparatus 120 described above; accordingly, the apparatus 320 will be described herein only to the extent that it differs from the apparatus 120. The characters employed in reference to the apparatus 320 will be the same as those employed in reference to the apparatus 120 plus 200; where any reference characters are skipped in the following discussion, the elements referred to by those skipped reference characters are exactly the same in the apparatus 320 as the elements corresponding thereto in the apparatus 120.

The spray texturing apparatus 320 basically comprises an aerosol container 322, a valve assembly 324 mounted on the container 322, and an outlet member 326 attached to the valve assembly 324. The valve assembly 324 further comprises an actuator member 336. The primary difference between the apparatus 120 and the apparatus 320 is in the construction of the outlet member 326 and the actuator member 336 and the manner in which these members 326 and 336 inter-operate.

In particular, the outlet member 326 simply comprises a disc portion 358. An attachment means 376 for attaching the outlet member 326 to the actuator member 336 basically an annular ring 374 having a center axis E fastened to the actuator member 236. An annular projection 380 extends inwardly from the ring 374. The diameter of the disc portion 358 is substantially the same as that of the ring 374, taking into account tolerances, and slightly larger than that of the projection 380.

The outlet member 326 is attached to the actuator member 336 by placing the outlet member 326 within the ring 374 and attaching the ring 374 onto the actuator member 336 with: (a) the outlet member 326 between the annular projection 380 and an outlet surface 368 of the actuator member 336; and (b) a center axis D of the disc member 358 aligned with the axis E of the ring 374 and a center axis F of the actuator member 336. The outlet member 326 can rotate within the ring 374 about the axes D, E, and F, and the annular projection 380 prevents inadvertent removal of the outlet member 326 from the actuator member 336. A handle 382 is provided on the outlet member 326 to facilitate rotation outlet member 326.

The attachment means 376 accomplishes the same basic function as the attachment means 176 described above. The apparatus 320 thus operates in all other respects in the same basic manner as the apparatus 120 described above.

Figure 25:
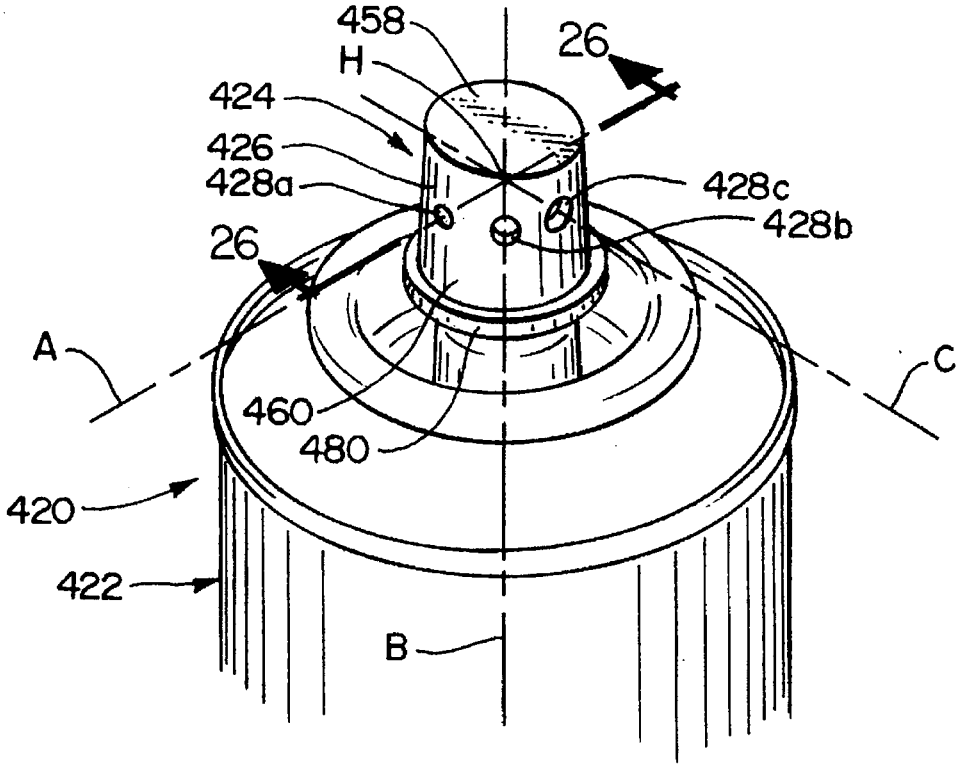
FIG. 25 is a perspective view of another exemplary spray texturing apparatus constructed in accordance with, and embodying, the principles of the present invention.
Figure 26:
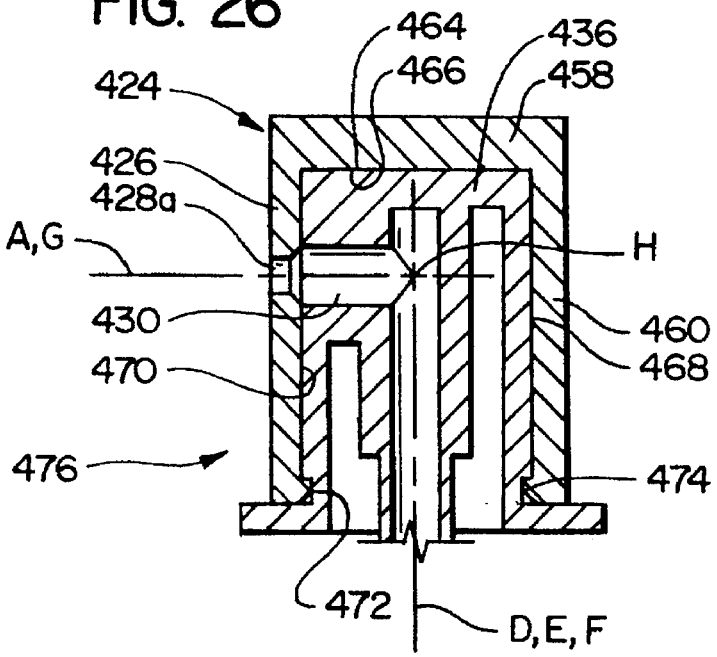
FIG. 26 is a partial cut-away view taken along lines 26—26 in FIG. 25.

Referring now to FIGS. 25 and 26, depicted therein at 420 is yet another exemplary spray texturing apparatus constructed in accordance with, and embodying, the principles of the present invention. The spray texturing apparatus 420 operates in the same basic manner as the apparatus 120 described above; accordingly, the apparatus 420 will be described herein only to the extent that it differs from the apparatus 120. The characters employed in reference to the apparatus 420 will be the same as those employed in reference to the apparatus 120 plus 300; where any reference characters are skipped in the following discussion, the elements referred to by those skipped reference characters are exactly the same in the apparatus 420 as the elements corresponding thereto in the apparatus 120.

The spray texturing apparatus 420 basically comprises an aerosol container 422, a valve assembly 424 mounted on the container 422, and an outlet member 426 attached to the valve assembly 424. The valve assembly 424 further comprises an actuator member 436. The primary difference between the apparatus 120 and the apparatus 420 is in the construction of the outlet member 426 and the actuator member 436 and the manner in which these members 426 and 436 inter-operate.

In particular, the outlet member 426 comprises a disc portion 458 having a lower surface 466 and a cylindrical portion 460 having an inner surface 470. In the exemplary apparatus 420, the actuator member 436 has an upper surface 464 and a cylindrical outer surface 468. When the valve assembly 424 is assembled, a center axis D of the disc portion 458, a center axis E of the cylindrical portion 460, and a vertical center axis F of the stem portion 436 are aligned.

An attachment means 476 for attaching the outlet member 426 to the actuator member 436 basically comprises an annular ring 472 formed on the outlet member cylindrical portion 460 and a notch or indentation 474 formed around the cylindrical outer surface 468 of the actuator member 436. This attachment means 476 allows the outlet member 426 to rotate relative to the actuator member 436 about the axes D, E, and F but prevents inadvertent removal of the outlet member 426 from the actuator member 436.

With this configuration, the first, second, and third outlet orifices 428*a*, 428*b*, and 428*c* are formed in the cylindrical portion 460 of the outlet member 426. These orifices 428*a*, 428*b*, and 428*c* are formed with their center axes A, B, and C orthogonal to, arranged at a given vertical point H along, and radially extending outwardly from the vertical center axis F of the stem portion 436. A center axis G of a nozzle passageway 430 formed in the actuator member 436 also is orthogonal to, radially extends from, and intersects at the given point H the vertical center axis F of the stem portion 436.

To facilitate rotation of the outlet member 426 relative to the actuator member 436, a peripheral flange 480 is formed at the bottom of the actuator member 436. The user can grasp this flange 480 to hold the actuator member 436 in place as the outlet member 426 is being rotated about its axis D.

Thus, rotation of the outlet member 426 relative to the actuator member 436 about the axes D, E, and F allows any one of these orifices 428*a*, 428*b*, and 428*c* to be aligned with a center axis G of a nozzle passageway 430 formed in the actuator member 436. The first outlet orifice 428*a* is shown aligned with the nozzle passageway 430 in FIG. 26.

The attachment means 476 thus also accomplishes the same basic function as the attachment means 176 described above. Accordingly, the apparatus 420 operates in all other respects in the same basic manner as the apparatus 120 described above.

Referring now to FIGS. 27, 28, 29, and 30, depicted therein at 520 is another exemplary spray texturing apparatus constructed in accordance with, and embodying, the principles of the present invention. The spray texturing apparatus 520 operates in the same basic manner as the apparatus 120 described above; accordingly, the apparatus 520 will be described herein only to the extent that it differs from the apparatus 120. The characters employed in reference to the apparatus 520 will be the same as those employed in reference to the apparatus 120 plus 400; where any reference characters are skipped in the following discussion, the elements referred to by those skipped reference characters are exactly the same in the apparatus 420 as the elements corresponding thereto in the apparatus 120.

The spray texturing apparatus 520 basically comprises an aerosol container 522, a valve assembly 524 mounted on the container 522, and an outlet member 526 attached to the valve assembly 524. The valve assembly 524 further comprises an actuator member 536. The primary difference between the apparatus 120 and the apparatus 520 is in the construction of the outlet member 526 and the actuator member 536 and the manner in which these members 526 and 536 inter-operate.

In particular, in the apparatus 520 a nozzle passageway 530 formed in the actuator member 536 terminates at the top rather than the side of the actuator member 536. The outlet member 526 comprises a disc member 558 attached to an outlet surface 568 on the upper end of the actuator member 536. A hole 572 formed in the disc member 558 and a projection 574 formed on the outlet surface 568 comprise an attachment means 576 for attaching the outlet member 526 onto the actuator member 536.

The attachment means 576 allows the outlet member 526 to be rotated about a center axis D thereof relative to the actuator member 536 such that any one of the center axes A, B, or C of outlet orifices 528*a*, 528*b*, and 528*c* can be aligned with a center axis G of the nozzle passageway 520.

Finger engaging wings 580 and 582 are formed on the actuator member 536 to allow the user to depress the actuator member 536 and spray the texture material within the container without getting texture material on the fingers.

The nozzle passageway identified by the reference character 530*a* in FIG. 28 comprises a dog-leg portion 584 that allows a center axis G of the nozzle passageway 530*a* to be offset from a vertical center axis F of the stem portion 536 and the center axis D of the outlet member 526. In FIG. 30, the nozzle passageway 530*b* is straight and the center axis D of the outlet member 526 is offset from the vertical center axis F of the stem portion 536. In this case, the disc member 558*b* forming the outlet member 526 in FIGS. 29 and 30 has a larger diameter than does the disc member 558*a* forming the outlet member 526 in FIGS. 27 and 28.

Figure 31:
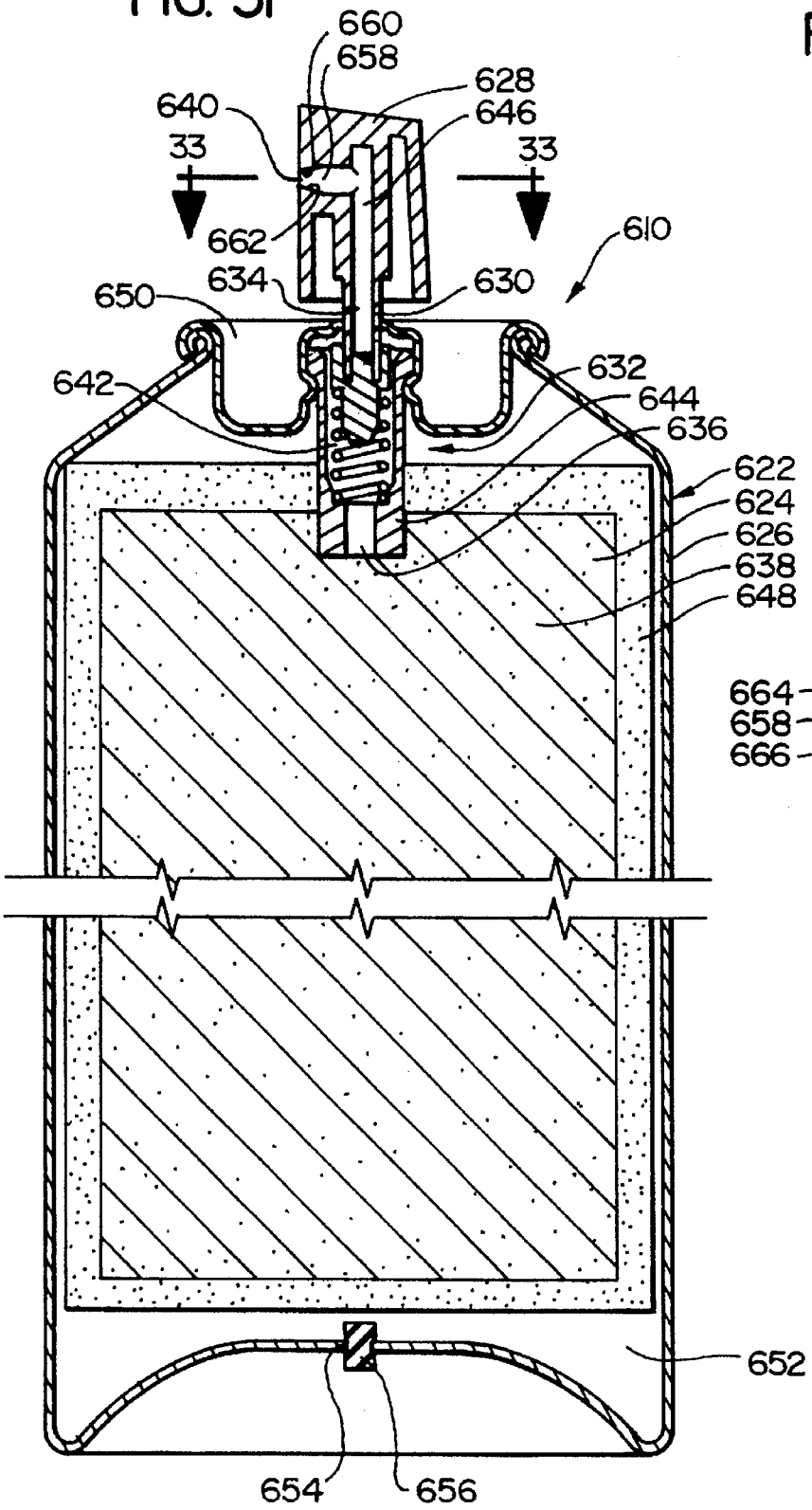
FIG. 31 is a side, cut-away view of a spray texturing apparatus constructed in accordance with, and embodying, the principles of the present invention.

Referring now to FIG. 31, depicted therein at 610 is yet another exemplary spray texturing apparatus constructed in accordance with, and embodying, the principles of the present invention. This apparatus 610 is similar to the apparatus 10 described above in that it is used to spray texture material onto the section of wallboard 12 having the previously sprayed surface portion 14 surrounding the unsprayed portion 16. The device 610 develops a spray similar to that indicated at 18 above, and thus deposits sprayed texture as indicated at 20 above.

The apparatus 610 incorporates an aerosol spray containing device 622, the basic design of which is or may be conventional in the prior art. Contained within this containing device 22 is a product bag or pouch 624 disposed within a generally cylindrical container 26 of the containing device 22.

The containing device 622 further comprises an actuator member 628 having a stem 630 that engages a valve assembly 632. The valve assembly 632 is basically conventional and either prevents or allows fluid flow along a dispensing path 634.

The dispensing path 634 extends between a collection opening 636 in communication with a product chamber 638 defined by the product pouch 624 and a dispensing opening 640 formed in the actuator member 628.

More particularly, the dispensing passageway 634 comprises a valve portion 542 defined by a housing member 644 of the valve assembly 632 and a nozzle portion 646 defined by the actuator member 628.

By depressing the actuator member 628 towards the interior of the container 626, the valve assembly 632 is placed in an open position that allows fluid flow from the interior chamber 638 of the product pouch 624, through the dispensing passageway 634, and out of the apparatus 610 through the dispensing opening 640.

Referring now more particularly to the product pouch 624, this pouch 624 comprises two sheets that are glued together along a perimeter portion 648. The view shown in FIG. 31 shows only one of these sheets 648, the other sheet 648 being in the section of the apparatus 610 that has been removed.

This seam portion 648 engages the valve housing 644 in a fluid-tight manner. Additionally, the valve housing 644 engages a cap portion 650 of the container 622 which engages the cylindrical portion 626. The junctures between the valve housing 644 and cap portion 650 and between the cap portion 650 and the container 626 are all fluid-tight. Accordingly, under normal conditions, fluid will not be able to flow between the product chamber 638 and an interior chamber 652 defined by the container 626.

The apparatus 610 operates basically as follows. Initially, the product pouch is placed into the container 622. The texture material is then placed into the product chamber 638 of the product pouch 624. A propellant material is then introduced into the interior chamber 652 through a port 654. The port 654 is then closed using a stopper 656.

The propellant material within the interior chamber 652 is pressurized and acts on the texture material within the product chamber 638 through the product pouch 624. When the actuator member 628 is depressed, the pressure exerted by the propellant material causes the texture material to leave the product pouch 624 through the dispensing passageway 634.

The propellant material itself may be either an inert gas such as air or nitrogen or could be a hydrocarbon propellant such as dimethylethylene.

The product pouch 624 ensures that the propellant material will not escape through the dispensing passageway 634 even when the apparatus 610 is inverted.

Because the propellant material is not mixed with the texture material, the texture material is not vaporized as it leaves the dispensing opening 640. Accordingly, with a traditional actuator member, the texture material would exit the apparatus 610 in a thin stream that would be inappropriate to form the spray 18 as described above.

Accordingly, an exterior end 658 of the dispensing passageway 634 is configured to engage the stream of texture material flowing through the dispensing passageway 634 in a manner that causes this material to spread out in a fan-shaped pattern as it leaves the apparatus 610. The spray 18 formed by the apparatus 610 is thus more fan-shaped than frustoconical as is the spray 18 formed by the device 10 described above.

Figure 32:
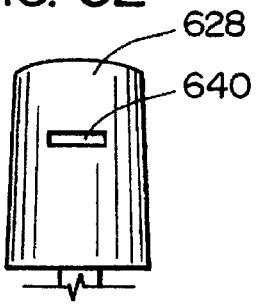
FIG. 32 is a front view of an actuator portion of the texturing apparatus shown in FIG. 33.
Figure 33:
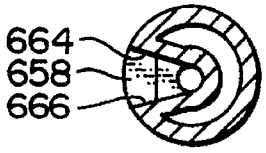
FIG. 33 is a top section view taken along lines 35—35 in FIG. 31.

More particularly, the exterior end 658 of the dispensing passageway 634 narrows in a first dimension and widens in a second dimension towards the dispensing opening 640. The dispensing opening 640 is thus an elongate slot as shown in FIG. 32. FIG. 31 shows the exterior end 658 of the dispensing passageway 634 has upper walls 660 and 662 that converge towards each other along the dispensing passageway 634 towards the dispensing opening 640. Additionally, FIG. 33 shows that the exterior end 658 of the dispensing passageway 634 is defined by diverging sidewalls 664 and 666. These walls 660 through 666 act on the texture material flowing through the dispensing passageway 634 in a manner that prevents this material from forming a narrow stream; the texture material instead forms a fan-shaped spray pattern that is appropriate for the application of texture material onto the wall 12.

Figure 34:
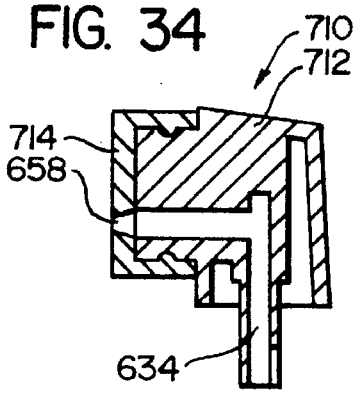
FIG. 34 is a side, cut-away view of an actuator member that may be used with the spray texturing apparatus shown in FIG. 31.
Figure 35:
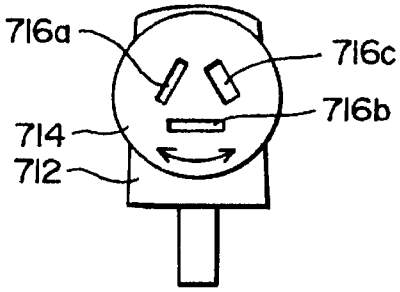
FIG. 35 is a front view of the actuator member shown in FIG. 34.

Referring now to FIGS. 34 and 35, depicted therein at 710 is an actuator assembly that may be substituted for the actuator member 628 described above. In particular, the actuator assembly 710 comprises an actuator member 712 and an outlet member 714. The outlet member 714 is generally similar in construction and operation to any of the outlet members 126, 226, 326, 426, and 626 described above.

In particular, the outlet member 714 has a plurality of dispensing openings 716*a*, 716*b*, and 716*c*. Each of these openings 716 has converging and diverging walls that engage the texture material as it exits the dispensing passageway 634 in a manner that causes the texture material to form a fan-shaped spray pattern. Additionally, the cross-sectional area of these openings 7161, 716*b*, and 716*c* are all different. These differing cross-sectional areas create different texture patterns as the texture material is deposited onto the wall 12. In general, the smaller the cross-sectional area of the dispensing opening 716, the finer the pattern of texture material formed on the wall 12.

Additionally, as with the outlet members described above, the outlet member 714 is rotatable relative to the actuator member 712 such that any one of the three dispensing openings 716 may form the exterior portion 658 of the dispensing passageway 634. The physical mechanism that allows the outlet member 714 to be rotated relative to the actuator member 712 could be any of those described above with reference to the outlet members 126, 226, 326, 426, and 626. This mechanism will thus not be described herein in further detail.

Figure 36:
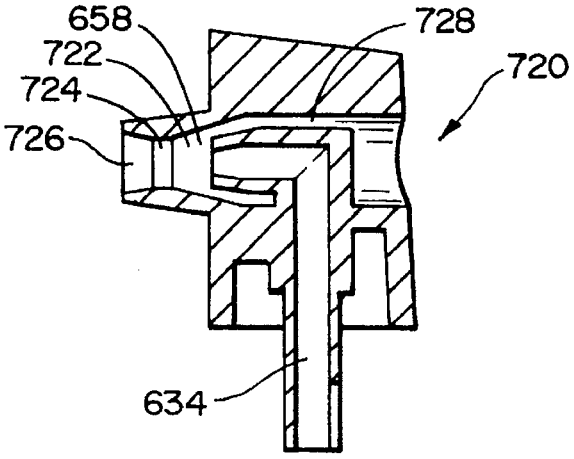
FIG. 36 is a side, cut-away view of an actuator member incorporating a venturi affect spray nozzle.

Another means of developing a spray instead of a stream is embodied in the actuator member 720 shown in FIG. 36. This actuator member 720 uses the venturi affect to introduce air into the stream of texture material as it is dispensed; the air so introduced breaks up the texture material and forms a spray pattern similar to that pattern 18 formed by the apparatus 10 described above.

In particular, the exterior portion 658 of the dispensing passageway 634 comprises a mixing portion 722, a throttle portion 724, and an outlet portion 726. An air channel 728 allows fluid communication between ambient air and the mixing chamber 722. Material flowing through the dispensing passageway 34 will enter the mixing portion 722 where it is mixed with air introduced through the air channel 728. The texture material will then continue through the throttle portion 724 and the outlet portion 726. The throttle portion 724 has a smaller cross-sectional area than the mixing portion 722 and the outlet portion 726. The actuator member 720 will result in air being mixed with the texture material as it exits the apparatus 610 to form a spray.

Figure 37:
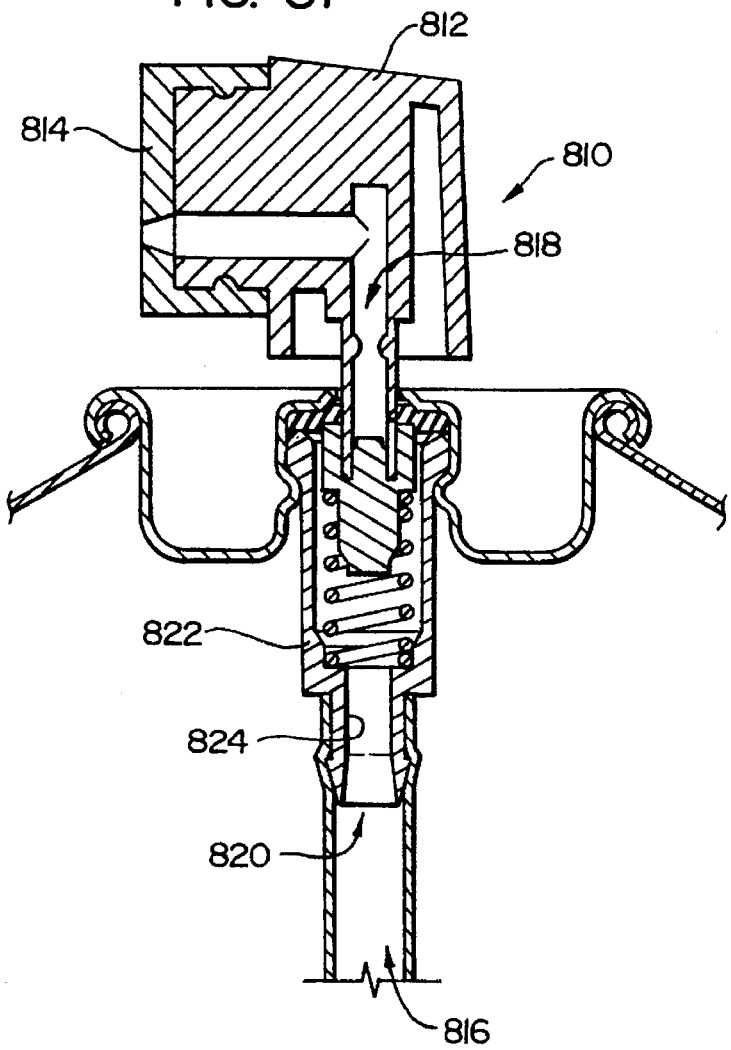
FIG. 37 is a partial, side, cut-away view of yet another exemplary spray texturing apparatus constructed in accordance, and embodying, the principles of the present invention.

Referring now to FIG. 37, depicted therein at 810 is yet another exemplary apparatus for applying spray texture material. This apparatus 810 is constructed in essentially the same manner as the apparatus 120 described in FIGS. 19 and 20, and will be described herein only to the extent that it differs therefrom.

In particular, while the apparatus 120 allows the successful development of a spray 18 for depositing texture material onto a surface such as the surface 12, this apparatus 120 does not obtain the benefits of the elongate passageways provided by the straws employed by the apparatus 10 described with reference to FIGS. 1 through 18. In particular, the Applicants have determined that the elongate passageway of the straw members 24 employed by the apparatus 10 provided improved spray texture patterns for long periods of time. Because the outlet member of the apparatus 120 does not provide such an elongate passageway, the spray patterns formed thereby may tend to deteriorate more quickly than those generated by the apparatus 10.

Referring now in more detail to FIG. 37, it can be seen that the apparatus 810 comprises an actuator member 812, an outlet member 814, and structure defining an elongate dispensing passageway 816 through which texture material passes as it is dispensed from the apparatus 810.

At some point along the dispensing passageway 816, one or more restriction structures such as those depicted at 818 and 820 are formed to impede the flow of texture material through the dispensing passageway 816. The restriction structure 818 is in the form of an annular projection extending from the actuator member 812 into the dispensing passageway 816. This annular member restricts the flow of texture material flowing through the passageway 816.

The structure 820 is in the form of an elongate passageway having dimensions similar to those of the straws employed by the apparatus 10 described above.

The idea of both the annular projection 818 and elongate passageway defining member 820 is that these structures impede the flow of fluid through the dispensing passageway 816. The Applicants believe that, by impeding the flow of texture material leaving the apparatus 810, the rate at which the pressure of the gasified propellant material within the apparatus 810 drops is decreased. By decreasing the rate of pressure drop, the pressure of the gaseous phase propellant is held above a predetermined level for a longer period of time. The predetermined pressure level is the level at which the pressure of the gaseous phase propellant is insufficient to provide an acceptable spray pattern.

While the exemplary restricting structures 818 and 820 may be configured to provide the delay in pressure drop required to increase the time it takes for the pressure of the gaseous phase propellant to drop below the predetermined level, any other structure that achieves this end may also be employed. For example, providing a baffle means or S-curves or other tortuous passageways that increase the resistance to the texture material could be used. However, the preferred way of obtaining this increased resistance to flow of the texture material is simply to configure a bayonet engaging portion 820 of the valve housing 822 such that inner walls 824 thereof act on the texture material flowing through the passageway 816 in a manner similar to that of the straws 24 described above.

It is to be recognized that various modifications can be made without departing from the basic teaching of the present invention.

What is claimed is:

1. An apparatus for applying a desired texture onto a surface in a desired texture pattern that matches a pre-existing texture pattern, comprising:

a) a container structure defining a main chamber;

b) an actuator member;

c) an interface structure located within the container structure, where the interface structure divides the main chamber into a first sub-chamber containing texture material and a second sub-chamber containing a propellant, the texture material being characterized by its tendency to form a stream as it exits a cylindrical passageway under pressure;

d) a collection structure defining a collection portion of a dispensing passageway;

e) a discharge structure defining a discharge portion of the dispensing passageway, where fluid flowing through the discharge portion of the dispensing passageway flows along a discharge axis;

f) valve means for defining a valve portion of the dispensing passageway and for creating, in response to displacement of the actuator member into an open position, an exit path by which texture material may flow from the first sub-chamber out of the container structure through the dispensing passageway; and g) a spray structure defining an outlet portion of the dispensing passageway; wherein h) the outlet portion of the dispensing passageway is arranged adjacent to the surface such that, when the actuator member is displaced into the open position, the propellant acts on the texture material through the interface structure to cause the texture material to pass into a collection opening, through the dispensing passageway, out of a discharge opening, and onto the surface, where the texture material hardens; and i) the spray structure acts on the texture material within the outlet portion of the dispensing passageway to cause at least a portion of the texture material flowing through the dispensing passageway to leave the dispensing passageway at an angle with respect to discharge axis, resulting in a spray of texture material discharged from the discharge opening appropriate for depositing the texture material onto the surface in the desired texture pattern to match the pre-existing texture pattern.

2. An apparatus as recited in claim 1, in which the spray structure comprises selecting means for allowing the operator to select a cross-sectional area of the outlet portion of the dispensing passageway to obtain the desired texture.

3. An apparatus as recited in claim 2, in which the selecting means comprises an outlet member having a plurality of outlet passageways formed therein, wherein:

a) each of the outlet passageways has a different cross-sectional area; and b) the operator moves the outlet member relative to the dispensing passageway such that one of the outlet passageways forms the outlet portion of the dispensing passageway.

4. An apparatus as recited in claim 1, in which the discharge portion of the dispensing passageway is defined by the actuator member.

5. An apparatus as recited in claim 1, in which the spray structure comprises one or more walls canted towards the discharge axis.

6. An apparatus as recited in claim 1, in which the spray structure comprises one or more walls canted away from the discharge axis.

7. An apparatus as recited in claim 5, in which the spray structure further comprises one or more walls canted away from the discharge axis.

8. An apparatus as recited in claim 3, in which each outlet passageway comprises one or more walls canted towards the discharge axis.

9. An apparatus as recited in claim 3, in which each outlet passageway comprises one or more walls canted away from the discharge axis.

10. An apparatus as recited in claim 9, in which each outlet passageway further comprises one or more walls canted away from the discharge axis.

11. An apparatus as recited in claim 1, in which the spray structure employs the venturi effect.

12. An apparatus as recited in claim 11, in which the spray structure comprises a portion defining a mixing chamber, a portion defining an air channel, a portion defining an outlet chamber, and a portion defining a throttle chamber, where the air channel allows ambient air to enter the mixing chamber and the throttle chamber is located between the mixing chamber and the outlet chamber.

13. A method of applying spray texture to a surface in a desired pattern, comprising the steps of:

a) providing a container defining a main chamber;

b) providing an actuator member;

c) mounting an interface member within the main chamber such that the interface member defines a first sub-chamber and a second sub-chamber;

d) placing texture material in the first chamber, the texture material being characterized by its tendency to form a stream as it exits a cylindrical passageway under pressure;

e) placing pressurized propellant material in the second chamber such that the propellant material acts on the texture material through the interface member;

f) providing an outlet structure defining a dispensing passageway that allows fluid flow between the first chamber and an exterior of the container, the dispensing passageway having a collection portion, a valve portion, a discharge portion, and an outlet portion, where fluid flowing through the discharge portion of the dispensing passageway flows along a discharge axis;

g) providing a valve assembly for creating, in response to displacement of the actuator member into an open position, an exit path by which texture material may flow from the first chamber, through the dispensing passageway, and to the exterior of the container;

h) arranging the outlet portion of the discharge passageway adjacent to the surface;

i) displacing the actuator member into the open position such that the propellant material forces the texture material to flow through the dispensing passageway, where the outlet structure is configured such that the portion thereof defining the outlet portion of the dispensing passageway acts on at least a portion of the texture material flowing through the dispensing passageway to cause the at least a portion of the texture material to form a spray appropriate for depositing the texture material onto the surface in the desired texture pattern to match the pre-existing texture pattern;

j) arranging the container relative to the surface such that the texture material exiting the dispensing passageway is deposited on the surface in the desired pattern; and k) allowing the texture material to harden.

14. A method as recited in claim 13, further comprising the step of selecting a cross-sectional area of the discharge opening to obtain the desired texture.

* * * * *